US012410034B2

(12) United States Patent
Baranov et al.

(10) Patent No.: US 12,410,034 B2
(45) Date of Patent: Sep. 9, 2025

(54) SPOOL HAVING FLANGE WITH LOCKING NOTCH

(71) Applicant: WINDAK INC., Conover, NC (US)

(72) Inventors: Fedor Baranov, East Greenbush, NY (US); Daniel L. Shelander, Hickory, NC (US)

(73) Assignee: WINDAK INC., Conover, NC (US)

( * ) Notice: Subject to any disclaimer, the term of this patent is extended or adjusted under 35 U.S.C. 154(b) by 209 days.

(21) Appl. No.: 18/223,283

(22) Filed: Jul. 18, 2023

(65) Prior Publication Data

US 2025/0026608 A1 Jan. 23, 2025

(51) Int. Cl.

| | |
|---|---|
| ***B65H 75/14*** | (2006.01) |
| ***B65H 75/28*** | (2006.01) |
| *B65H 75/30* | (2006.01) |

(52) U.S. Cl.

CPC ..... *B65H 75/285* (2013.01); *B65H 75/14* (2013.01); *B65H 75/30* (2013.01)

(58) Field of Classification Search

CPC ..... B65H 75/14; B65H 75/28; B65H 75/30; B65H 75/285; B65H 65/00

See application file for complete search history.

(56) References Cited

U.S. PATENT DOCUMENTS

| | | | | |
|---|---|---|---|---|
| 2,417,587 A | | 3/1947 | Damstra | |
| 3,758,045 A | | 9/1973 | Allen | |
| 4,387,863 A | | 6/1983 | Edmonston et al. | |
| 4,616,790 A | | 10/1986 | Beltran | |
| 4,657,203 A | | 4/1987 | Crawford | |
| 4,938,432 A | | 7/1990 | Kurt et al. | |
| 5,246,184 A | | 9/1993 | Trewhella, Jr. | |
| 5,255,866 A | * | 10/1993 | Campolo | H02G 11/02 24/910 |

(Continued)

FOREIGN PATENT DOCUMENTS

| | | | |
|---|---|---|---|
| CA | 996912 | A | 9/1976 |
| CN | 104896199 | A | 9/2015 |

(Continued)

OTHER PUBLICATIONS

European Patent Office, Extended European Search Report, Dec. 2, 2024, pp. 1-4, EPO, Munich DE.

*Primary Examiner* — Sang K Kim

(74) *Attorney, Agent, or Firm* — CHRISTOPHER C. DREMANN, P.C.; Christopher C. Dremann

(57) ABSTRACT

A spooler for winding a material onto a spool includes a feeding unit for feeding the material to the spool and a spool drive flange for winding the material onto the spool. The spool includes a barrel and at least one flange disposed on the barrel. The flange is provided with a locking notch having a receiving portion for receiving an outermost end of the material and a retaining portion for retaining the outermost end of the material within the locking notch. The receiving portion or the retaining portion may have a reduced cross-section area for securing the outermost end of the material. A method for retaining a length of a continuous, elongate, flexible material on a spool includes winding the material onto the spool and retaining an outermost end of the material within a locking notch provided on at least one flange of the spool.

16 Claims, 13 Drawing Sheets

(56) References Cited

U.S. PATENT DOCUMENTS

| | | | | |
|---|---|---|---|---|
| 5,460,333 | A * | 10/1995 | Vanhuyse | B65H 75/28 242/476.6 |
| 5,485,968 | A | 1/1996 | Fujioka | |
| 7,891,599 | B2 | 2/2011 | Kishimoto et al. | |
| 9,073,263 | B2 | 7/2015 | Mannella et al. | |
| 10,086,419 | B2 | 10/2018 | Introini et al. | |
| 11,345,564 | B2 | 5/2022 | Ash et al. | |
| 2002/0023984 | A1 | 2/2002 | Oppmann et al. | |
| 2012/0322297 | A1 | 12/2012 | Frenkil | |
| 2023/0101194 | A1 | 3/2023 | Edstrom | |

FOREIGN PATENT DOCUMENTS

| | | | |
|---|---|---|---|
| DE | 202021003670 | U1 | 7/2022 |
| FR | 2250348 | A | 5/1975 |
| FR | 3027168 | A | 4/2016 |
| KR | 20150113748 | A | 10/2015 |
| KR | 1020150113748 | A | 10/2015 |
| WO | 2023117396 | A1 | 6/2023 |

* cited by examiner

SPOOL HAVING FLANGE WITH LOCKING NOTCH

FIELD OF THE INVENTION

The present invention relates generally to an apparatus and method for winding a length of continuous, elongate, flexible material onto a spool and for retaining a free end of the material on the spool. In an embodiment, the invention is a spool for receiving a length of a continuous, elongate, flexible material wound onto the spool wherein the spool has a flange with a locking notch for retaining an outermost free end of the wound material on an outer periphery of the flange.

BACKGROUND OF THE INVENTION

A generally cylindrical container having an axial through opening and a generally planar rim adjacent at least one end is commonly utilized for winding, storing and subsequently dispensing a length of a continuous, elongate, flexible media or the like. The container may be a reel, hub, bobbin, spindle, spool or the like, and is collectively referred to herein as a spool. The rim adjacent at least one end of the spool may be a collar, ridge, rib, flange or the like, and is collectively referred to herein as a flange. The continuous, elongate, flexible media or the like is typically a relatively thin or small diameter material, such as wire, fiber, rope, string, electrical cable, optical cable or filament. The material is wound onto the spool and stored on the spool, for example while being inventoried and during transport. By way of example and not limitation, the material wound onto the spool may be a three-dimensional (3D) printing filament that is wound onto the spool and subsequently dispensed from the spool for use in a production process, such as a 3D printing process. In some instances, the spool of wound material is provided with exterior packaging material, such as at least one layer of stretch wrap. The stretch wrap retains the outermost free end of the material wound onto the spool to prevent the wound material from unwinding and to protect the wound material from being damaged during storage or transport. The stretch wrap is subsequently removed to allow the wound material to be dispensed from the spool, for example to be used in a production process.

Winding equipment for winding a continuous, elongate, flexible material onto a spool is commonly known and is referred to herein as a spooler. The use of stretch wrap to retain the outermost free end of the wound material requires packaging equipment, namely, a stretch wrap applicator, in addition to the spooler. An example of a known spooler and stretch wrap applicator is shown and described in United States Patent Application Publication No. 2015/0360800 A1. The cost, size and complexity of the spooler is increased by the addition of the stretch wrap applicator and the stretch wrap, while at the same time the speed and efficiency of the spooling process is reduced. Furthermore, the stretch wrap must be removed before the wound material can be dispensed from the spool for use, likewise increasing the cost, while reducing the speed and efficiency of the corresponding production process. The stretch wrap removed from the spool is not reused and must be disposed or recycled. Consequently, it is not always necessary, or even desirable, to protect the wound material on the spool with stretch wrap. Nevertheless, it remains necessary, or at the least desirable, to retain the outermost free end of the material wound on the spool to prevent the wound material from unwinding from the spool prior to being dispensed from the spool for use in a production process.

In view of these shortcomings, problems, deficiencies and drawbacks, it is apparent that improved winding equipment is needed for winding a continuous, elongate, flexible material onto a spool and retaining an outermost free end of the wound material on the spool. A particular need exists for a spooler for winding a length of a continuous, elongate, flexible material onto a spool and for retaining the outermost free end of the wound material on the spool. A still further need exists for a spool that does not require a stretch wrap applicator and stretch wrap to retain the outermost free end of the wound material on the spool. Such a spooler and spool would reduce the cost, size and complexity of the spooler, while increasing the speed and efficiency of the spooling process and the subsequent production process. Furthermore, such a spooler and spool would obviate the need to remove the stretch wrap before dispensing the wound material from the spool. A further need exists for an automated spooler that provides the option to apply at least one layer of stretch wrap to material wound onto a spool, or alternatively, to retain an outermost free end of the wound material on the spool within a locking notch formed on an outer periphery of a flange of the spool.

SUMMARY OF THE INVENTION

The present invention addresses the shortcomings, problems, deficiencies and drawbacks associated with existing spoolers for winding a length of a continuous, elongate, flexible material onto a spool and retaining an outermost free end of the wound material on the spool. In particular, the present invention provides a significant improvement and advantage over existing winding equipment that utilizes a stretch wrap applicator and stretch wrap to retain an outermost free end of the material wound on the spool. In advantageous embodiments, the invention is an automated spooler, a spool having a flange with a locking notch and associated methods for winding a length of a continuous, elongate, flexible material onto the spool and for retaining an outermost free end of the wound material on an outer periphery of the flange.

In one aspect, the invention is embodied by a spooler for winding a length of a continuous, elongate, flexible material onto a spool. In an embodiment, the spooler is an automated spooler including a winding enclosure and a conveying unit configured and operable for automatically conveying an empty spool into the winding enclosure and for automatically conveying a spool of wound material out of the winding enclosure to a collection area. The automated spooler further includes an indexing unit within the winding enclosure configured and operable for automatically positioning a feed hole provided on the spool at a predetermined location for feeding the material to the spool. The automated spooler further includes a feeding unit within the winding enclosure configured and operable for automatically feeding an innermost free end of the material through the feed hole provided on the spool. The automated spooler further includes a spooling unit within the winding enclosure configured and operable for automatically gripping the innermost free end of the material and rotating the spool to wind the material onto the spool.

In an embodiment, the indexing unit includes at least one roller for rotating the spool on the indexing unit to position the feed hole at the predetermined location for feeding the material to the spool. The at least one roller may have at least one groove for receiving a flange provided on the spool adjacent an axial end of the spool.

In an embodiment, the feeding unit is disposed above the indexing unit with the feed hole positioned at the predetermined location for feeding the material to the spool. The feeding unit is movable downwardly in a vertical direction from a retracted position to an extended position for feeding an innermost free end of the material to the spool. The feeding unit includes a cam plate and an associated cam that guide and position a feed tube above the feed hole provided on the spool and positioned at the predetermined location for receiving the innermost free end of the material. The feed tube of the feeding unit is configured and operable for feeding the innermost free end of the material through the feed hole provided on the spool. In an embodiment, the feed hole defines an opening that extends through an elongate, cylindrical barrel of the spool on an interior side of a flange adjacent an axial end of the barrel of the spool.

In an embodiment, the spooling unit includes an attachment clamp configured and operable for gripping the innermost free end of the material within the barrel of the spool while the material is being wound onto the spool during the spooling process. The attachment clamp includes a pair of clamping pins disposed within the interior of the barrel of the spool that close together to grip the innermost free end of the material within the barrel of the spool. The spooling unit further includes a spool drive that is configured and operable for transferring rotational movement to the spool during the spooling process. The spool drive may have a resilient or rough covering, pad or the like that provides increased friction between the spool drive and the spool during the spooling process. The clamping pins of the attachment clamp protrudes outwardly in the axial direction from the spool drive to grip the innermost free end of the material within the barrel of the spool.

In an embodiment, the spool drive is movable in an axial direction and is biased in the axial direction by a biasing element. When a spool is loaded into the spooling unit, a flange of the spool is positioned against the spool drive and the biasing element is compressed behind the spool drive. The spool drive of the spooling unit rotates the spool during the spooling process while the feed tube of the feeding unit feeds the material to the spool. Upon completion of the spooling process, the material wound onto the spool is retained on the spool and a cutting unit cuts an outermost free end of the wound material. The attachment clamp then releases the innermost free end of the material within the barrel of the spool and the compressed biasing element of the spooling unit exerts a biasing force on the spool drive to move the spool of wound material in the axial direction away from the spool drive so that the spool of wound material can be conveyed by the conveying unit out of the winding enclosure to the collection area.

In another aspect, the invention is embodied by an automated spooler including an optional packaging unit configured and operable for automatically applying at least one layer of stretch wrap to a spool of wound material. In an embodiment, the packaging unit is an automated stretch wrap applicator including an applicator clamp. The applicator clamp is movable between an opened position and a closed position to grip the stretch wrap and is rotatable around the spool to cover the spool of wound material with at least one layer of stretch wrap. The stretch wrap applicator further includes a cam plate having a cam profile that controls when the applicator clamp is in the opened position and when the applicator clamp is in the closed position. In the closed position, a clamp plate of the applicator clamp is pressed against a stop with an end of the stretch wrap disposed between the clamp plate and the stop. The applicator clamp of the stretch wrap applicator further includes a cutting blade operable for automatically cutting the stretch wrap once the spool of wound material is packaged with at least one layer of stretch wrap. The stretch wrap applied to the spool of wound material by the optional packaging unit retains the outermost free end of the material on the spool and protects the wound material from damage during storage or transport.

In another aspect, the invention is embodied by a spool for receiving a length of a continuous, elongate, flexible material wound onto the spool wherein the spool has a flange with a locking notch for retaining an outermost free end of the wound material on the spool. The spool includes a barrel that extends in an axial direction and at least one flange that extends outwardly from the barrel of the spool in a generally radial direction. In an embodiment, the flange is disposed adjacent an axial end of the barrel and the locking notch is formed at an outer periphery of the flange to retain an outermost free end of the wound material on the spool. In an embodiment, the flange is configured as a substantially planar, relatively thin, generally cylindrical disk and the locking notch is disposed along the circumference of an outer peripheral edge or rim of the flange.

In an embodiment, the locking notch defines a receiving portion that extends from the outer periphery of the flange and a retaining portion that extends from the receiving portion. The receiving portion may be tapered inwardly from the outer periphery of the flange towards the retaining portion of the locking notch. Similarly, the retaining portion may be tapered inwardly from the receiving portion of the locking notch. In an embodiment, a transition region defining a relatively small radius may be disposed between the receiving portion and the retaining portion to facilitate a smooth transition of the material from the receiving portion into the retaining portion of the locking notch. In an embodiment, the receiving portion or the retaining portion may have a reduced cross-section area configured and operable for securing an outermost end of the wound material while the material is cut. In an advantageous embodiment, the receiving portion of the locking notch extends in a generally circumferential direction, while the retaining portion extends in a generally radial direction. In another advantageous embodiment, the receiving portion of the locking notch extends in a generally radial direction, while the retaining portion extends in a generally circumferential direction.

In another aspect, the invention is embodied by a method for winding a length of a continuous, elongate, flexible material onto a spool and retaining an outermost free end of the material on the spool. The method includes conveying an empty spool into a winding enclosure of a spooler. The method further includes indexing the empty spool to position a feed hole provided on a barrel of the spool at a predetermined location for feeding the material to the spool. The method further includes feeding an innermost free end of the material through the feed hole provided on the spool. In an embodiment, the feed hole defines an opening that extends in a generally radial direction through the barrel of the spool. The method further includes gripping the innermost free end of the material within an interior of the barrel of the spool. The method further includes rotating the spool to wind a length of the material onto the spool during a spooling process.

In an embodiment, indexing the empty spool to position the feed hole provided on the barrel of the spool includes rotating the spool on at least one roller having at least one groove for receiving a flange adjacent an axial end of the barrel of the spool. The groove of the roller restricts movement of the spool on the spooler in an axial direction while the spool is rotated to position the feed hole at the predetermined location for feeding the innermost free end of the material to the spool.

In an embodiment, the method further includes rotating the spool to wind a length of the elongate, flexible material onto the spool and cutting an outermost free end of the material wound onto the spool. The method further includes optionally packaging the material wound onto the spool by applying at least one layer of shrink wrap onto the wound material to thereby retain an outermost free end of the wound material on the spool and to prevent damage to the wound material during storage or transport.

In another embodiment, the method further includes rotating the spool to wind a length of the elongate, flexible material onto the spool. The method further includes optionally retaining an outermost free end a length of the elongate, flexible material wound onto the spool within a locking notch provided on an outer periphery of a flange of the spool and cutting the material with the outermost free end of the material secured within the locking notch provided on the flange.

In another aspect, the invention is embodied by a method for winding a length of a continuous, elongate, flexible material onto a spool having a flange with a locking notch and retaining an outermost free end of the material within the locking notch on the flange. In an embodiment, the spool includes a barrel that extends in an axial direction and the spool includes at least one flange adjacent an axial end of the barrel of the spool. The at least one flange extends outwardly from the barrel in a generally radial direction and the locking notch is provided on an outer periphery of the flange. In an embodiment, the flange is configured as a substantially planar, relatively thin, generally annular disk, and the locking notch is formed on an outer periphery, or outer circumference, of the flange for retaining the outermost free end of the wound material on the spool. In an embodiment, the locking notch includes a reduced cross-section area for securing the outermost free end of the wound material while the material is cut.

In yet another aspect, the invention is embodied by a spooler and a spool having a flange with a locking notch for retaining an outermost free end of a length of a continuous, elongate, flexible material on an outer periphery of the flange. The spooler includes a feeding unit that is movable in an axial direction and in a radial direction for feeding the material to the spool. The spooler further includes a spooling unit configured and operable for rotating the spool during a spooling process. The feeding unit includes a feed tube configured and operable for feeding the material to the spool as the spooling unit rotates the spool to wind the material onto the spool. With a desired length of the material wound onto the spool, the feeding unit is operable to move the feed tube in the axial direction beyond an exterior surface of the flange of the spool.

In an embodiment, the spooling unit is operable to rotate the spool such that the locking notch is positioned at a predetermined location relative to the material extending from the feed tube and the material is retained within the locking notch provided on the outer periphery of the flange. The spooler further includes a cutting unit operable for cutting the material with an outermost free end of the material secured within the locking notch on the spool.

In another embodiment, the spooling unit is operable to rotate the spool such that the locking notch is positioned at a predetermined location relative to the material extending from the feed tube. The feeding unit is then operable to move the feed tube and the material inwardly in the radial direction such that the material is received within the locking notch on the outer periphery of the flange. The spooling unit is operable to further rotate the spool such that the material extending from the feeding tube is retained within the locking notch provided on the outer periphery of the flange. The spooler further includes a cutting unit operable for cutting the material with an outermost free end of the material secured within the locking notch on the spool.

In an embodiment, the flange is configured as a substantially planar, relatively thin, generally annular disk and the locking notch of the flange is formed on an outer periphery of the flange, or on an outer circumferential edge or rim of the flange. The spooler may further include an indexing unit configured and operable to position the locking notch on the flange at a predetermined location relative to the material extending from a feed tube. The material extending from the feed tube is received and retained within the locking notch when the spool is rotated. Alternatively, the material extending from the feed tube is received within the locking notch when the feed tube is moved inwardly in the radial direction and the material is retained within the locking notch when the spool is rotated in the circumferential direction. The material is then cut with an outermost free end of the material secured within the locking notch on the spool.

In an embodiment, the locking notch is formed in an outer circumferential edge or rim of the flange and includes a receiving portion that extends from the outer periphery of the flange to a receiving portion. In an embodiment, the receiving portion extends in a generally circumferential direction and the retaining portion extends in a generally radial direction to retain an outermost free end of the wound material on the spool within the locking notch. In another embodiment, the receiving portion extends in a generally radial direction and the retaining portion extends in a generally circumferential direction to retain an outermost free end of the wound material on the spool within the locking notch. The receiving portion or the retaining portion of the locking notch may have a reduced cross-section area for securing the outermost free end of the wound material on the spool while the material is cut.

In an embodiment, the spooler further includes a packaging unit having a stretch wrap applicator for packaging the material wound on the spool with at least one layer of a stretch wrap so that an outermost free end of the wound material is retained on the spool. The spooler further includes a controller unit operable for determining whether to activate the stretch wrap applicator to package the wound material on the spool with the at least one layer of stretch wrap, or alternatively, to retain the outermost free end of the wound material within a locking notch provided on an outer periphery of a flange of the spool.

DETAILED DESCRIPTION OF EXEMPLARY EMBODIMENTS OF THE INVENTION

Figure 1:
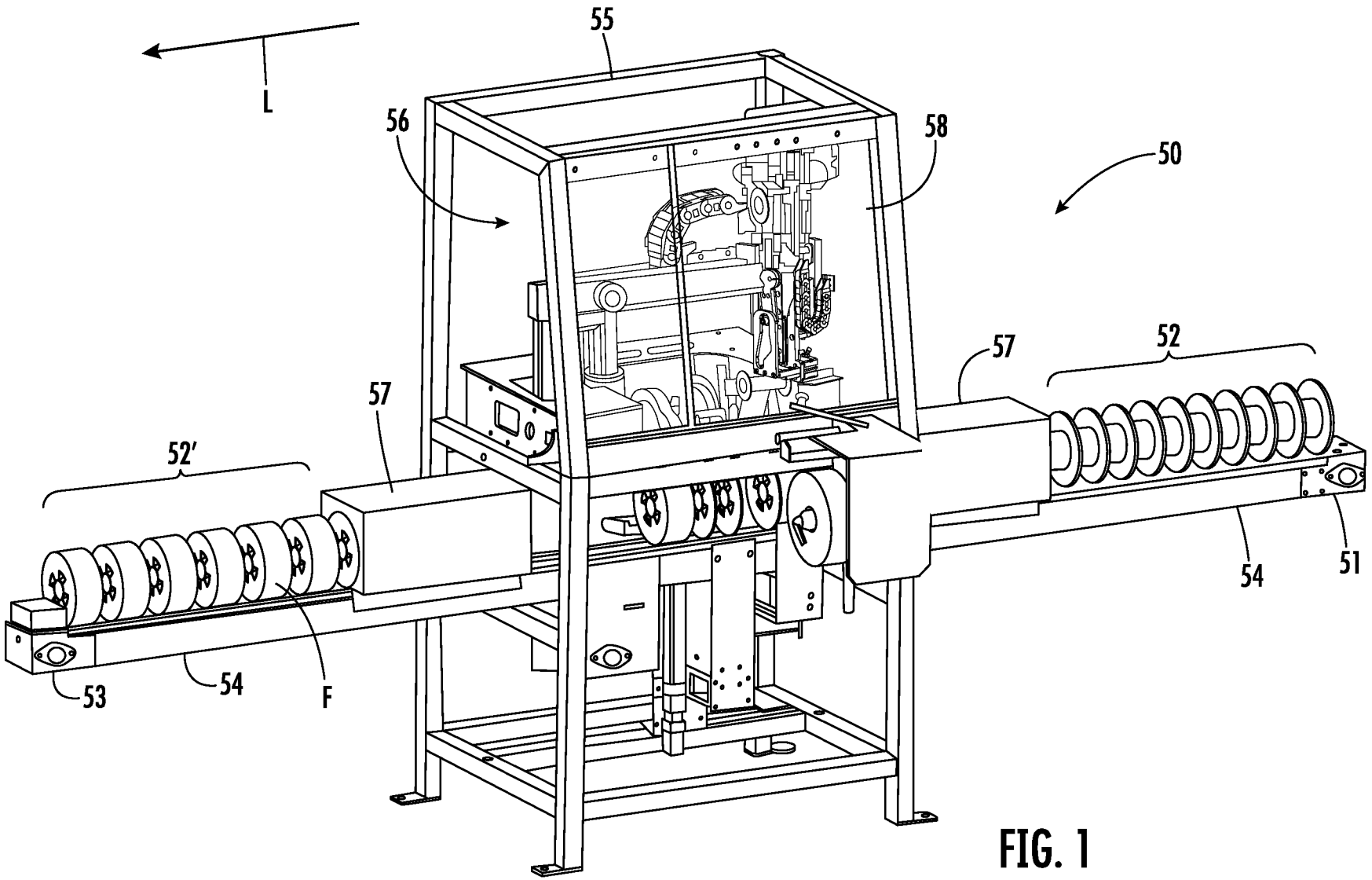
FIG. 1 is an environmental perspective view of a spooler according to an aspect of the present invention.

Referring now to the accompanying drawings, in which like reference characters refer generally to the same or similar parts, FIGS. 1-12 show a spooler according to an aspect of the present invention operable for winding a length of an elongate, flexible media onto a container for storing, transporting and subsequently dispensing the media from the container. By way of example and not limitation, the media may be tape, wire, electrical cable, optical cable, string, rope, fiber, filament or the like, and is collectively referred to herein as "a length of continuous, elongate, flexible material." By way of example and not limitation, the container may be a reel, hub, bobbin, spindle, spool or the like, and is collectively referred to herein as a "spool.". In the exemplary embodiments shown and described herein, the spooler is configured and operable for receiving an empty spool, winding a predetermined length of the material onto the spool, retaining an outermost free end of the material on the spool, and delivering the spool of wound material to a collection area.

In a particularly advantageous aspect of the invention, the spooler is an automated spooler and the material is a plastic filament, referred to as three-dimensional (3D) printing filament, that is useful in a three-dimensional (3D) printing process or production. The 3D printing filament may be formed by an extrusion production and wound onto a spool by the automated filament spooler. The spool of wound filament may optionally be packaged with a stretch wrap material to retain the wound filament on the spool during storage and transport until the filament is subsequently dispensed from the spool for use in the 3D printing process or production. Alternatively, according to another aspect of the invention, the outermost free end of the wound filament may be retained on a spool having a flange with a locking notch. Persons having ordinary skill in the art will readily understand and appreciate that the spool is manufactured independent of the material to be wound onto the spool, except that the construction of the spool, including without limitation its materials, dimensions, geometry, reinforcement elements, etc., may be influenced by the type of material. Furthermore, the automated spooler and/or spool of the invention may be utilized with other materials and other types of filaments, as well as in various other applications without departing from the scope of this disclosure.

The exemplary embodiments of a spooler shown and described herein are configured for use with continuous, elongate, flexible material, including by way of example and without limitation, 3D printing filament, having any desired cross-sectional shape (e.g., round, square, rectangular) or size. Regardless, it is intended that the invention be interpreted and construed broadly to encompass spoolers configured for automatically winding continuous, elongate, relatively thin or small diameter, flexible material onto spools, reels, hubs and the like, as well as other suitable articles of manufacture, collectively referred to herein as a spool, and for retaining the wound material on the spool, without unreasonable exception or alteration.

Figure 2:
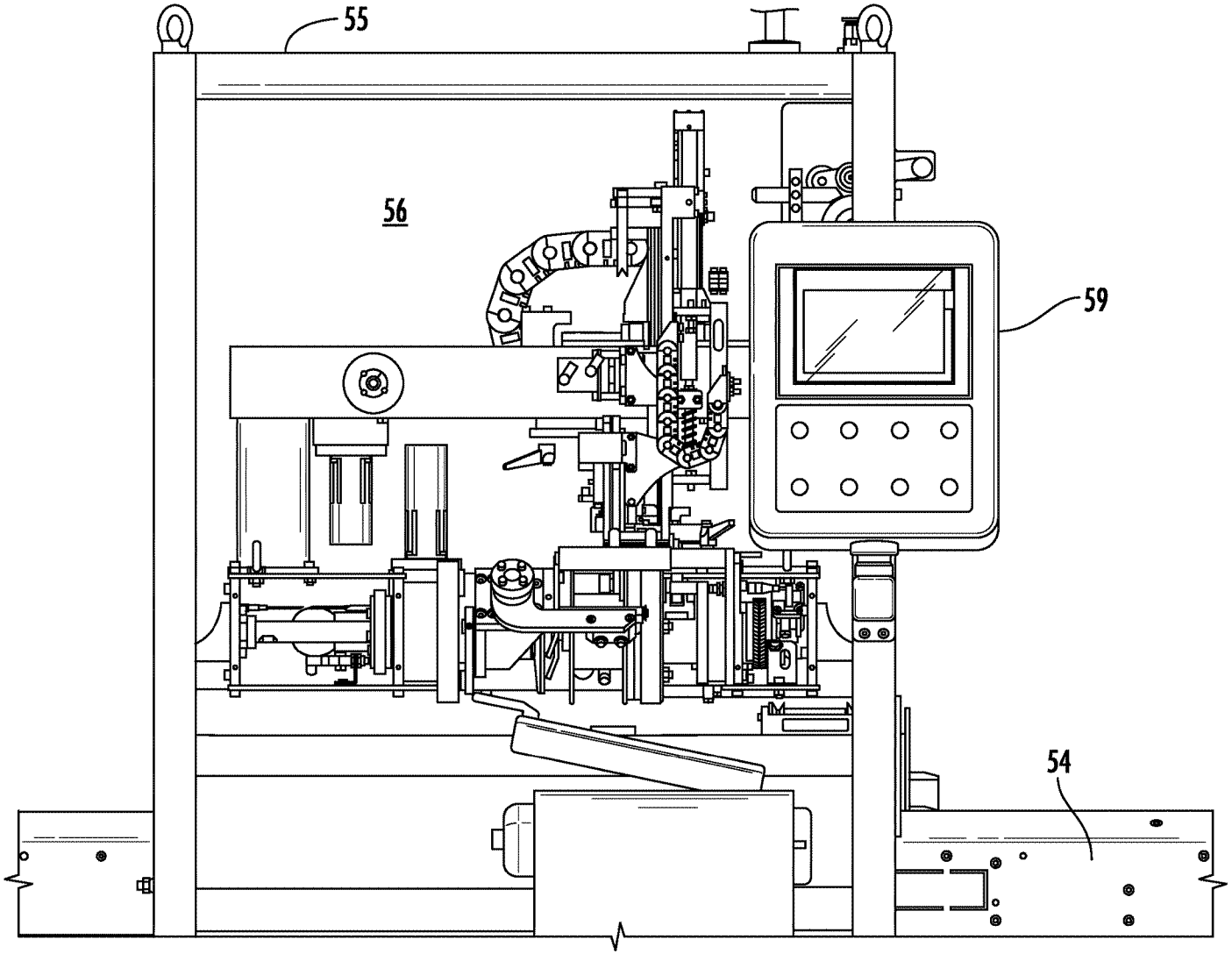
FIG. 2 is a detail front elevation view of a portion of the spooler of FIG. 1.
Figure 3:
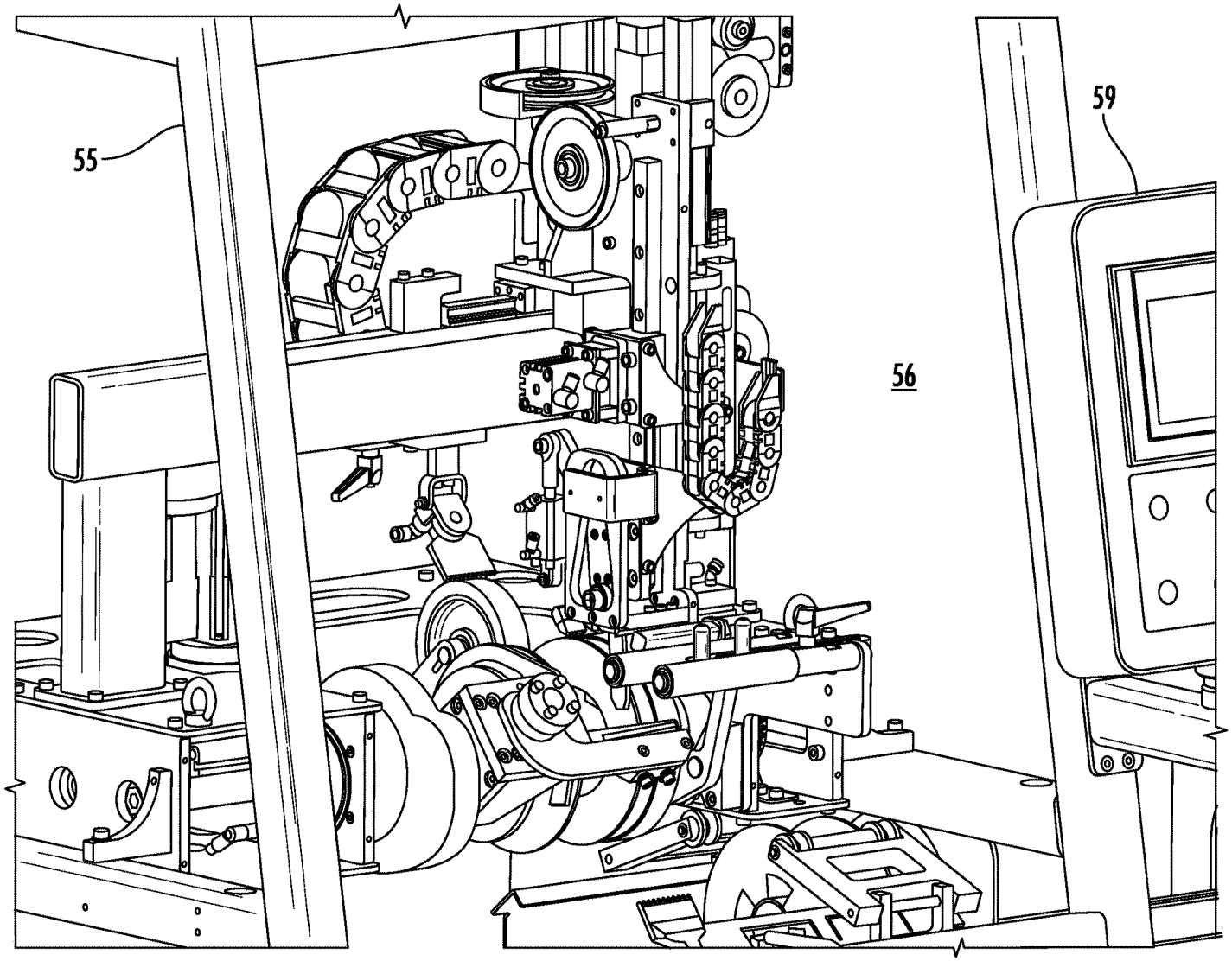
FIG. 3 is a detail perspective view of the portion of the spooler of FIG. 1.

FIGS. 1-12 show an automated spooler, indicated generally by reference character 50, according to an aspect of the present invention. In an advantageous embodiment, the automated spooler 50 is configured for an in-line production, such as an in-line extrusion production for manufacturing 3D printing filament. For purposes of illustration, FIG. 1 shows a plurality of empty spools 52 configured for having a length of a continuous, elongate, flexible material F, such as a plastic filament for 3D printing, wound thereon by the automated spooler 50, and a plurality of wound spools 52' having the filament F wound thereon by the automated spooler 50. FIG. 2 is a detail front elevation view of the automated spooler 50 and FIG. 3 is a detail perspective view of the automated spooler 50. The empty spools 52 and wound spools 52' are not shown in FIG. 2 and FIG. 3 for purposes of clarity. FIG. 2 and FIG. 3 further show an optional operator control panel 59 having, for example, an input keyboard and/or a display screen.

In FIG. 1, the automated spooler 50 is viewed from the operator side of the spooler 50. The empty spools 52 are loaded by an operator onto a conveyor 54 that extends along the automated spooler 50 in a lengthwise direction L between an intake side 51 and an outtake side 53 of the spooler 50. As shown herein for purposes of illustration only, the empty spools 52 are loaded onto the conveyor 54 from the intake side 51 at the right-hand end of the spooler 50. However, the empty spools 52 may be loaded onto the conveyor 54 from either the right-hand end or from the outtake side 53 at the left-hand end of the spooler 50, or from any desired direction (e.g., perpendicular to the lengthwise direction L). In any event the wound spools 52' are conveyed on conveyor 54 from the automated spooler 50 to the outtake side 53 and delivered to a collection area (not shown) to be removed by an operator following the winding process, which is also referred to herein as the spooling process. As will be described in greater detail, the wound spools 52' may also be packaged by an optional packaging process before being delivered to the collection area at the outtake side 53 of the spooler 50.

Importantly, the empty spools 52 are conveyed on conveyor 54 from the intake side 51 into the spooler 50 and the wound spools 52' are conveyed on conveyor 54 from the spooler 50 in an automated manner. Consequently, an operator is not required to manually load an empty spool 52 onto a spooling head or to manually remove a wound spool 52' from a spooling head. The spooler 50 further comprises a frame 55 having an enclosure 56 that defines an interior, safety covers 57 disposed over portions of the conveyor 54, and a lockable safety panel or door 58 for limiting access to the components of the spooler 50 within the interior of the enclosure 56. As a result, the automated spooler 50 is faster, more accurate, more efficient, and safer than a manual spooler.

Generally speaking, an empty spool 52 is conveyed on the conveyor 54 into the enclosure 56 from the intake side 51 of the automated spooler 50. The empty spool 52 is then indexed to position a feed hole provided on the spool 52 at a predetermined location for feeding the material to the spool 52. The properly indexed empty spool 52 is then releasably received on a spooling head. Next, a feeding unit automatically feeds an innermost free end of a continuous, elongate, flexible material to be wound onto the spool 52 through the feed hole provided on the spool 52. The spooling head of the spooler 50 automatically grips the innermost free end of the material received within the interior of the spool 52 through the feed hole. The spooling head of spooler 50 then automatically winds a predetermined length of the material onto the spool 52 and an outermost free end of the length of the material wound onto the spool 52 is cut to produce the wound spool 52'.

The automated spooler 50 next may optionally cover the material on the wound spool 52' with packaging, and in particular, with at least one layer of a stretch wrap. The remaining stretch wrap is then cut from the wound spool 52'. The wound spool 52' is then released from the spooling head and automatically conveyed on conveyor 54 out of the enclosure 56 of the spooler 50 to the outtake side 53 of the spooler 50. If desired, the spooler 50 may further comprise an optional automated fault detector (not shown) for detecting a possible fault in the material wound onto the spool 52' or a possible fault with the spool. In the event of a detected fault, the wound spool 52' is ejected from the conveyor 54 into a recycle bin for salvaging the wound material and/or the spool. Wound spools 52' without a detected fault accumulate in the collection area at the end of the conveyor 54 on the outtake side 53 of the automated spooler 50 to be removed by an operator.

Figure 4:
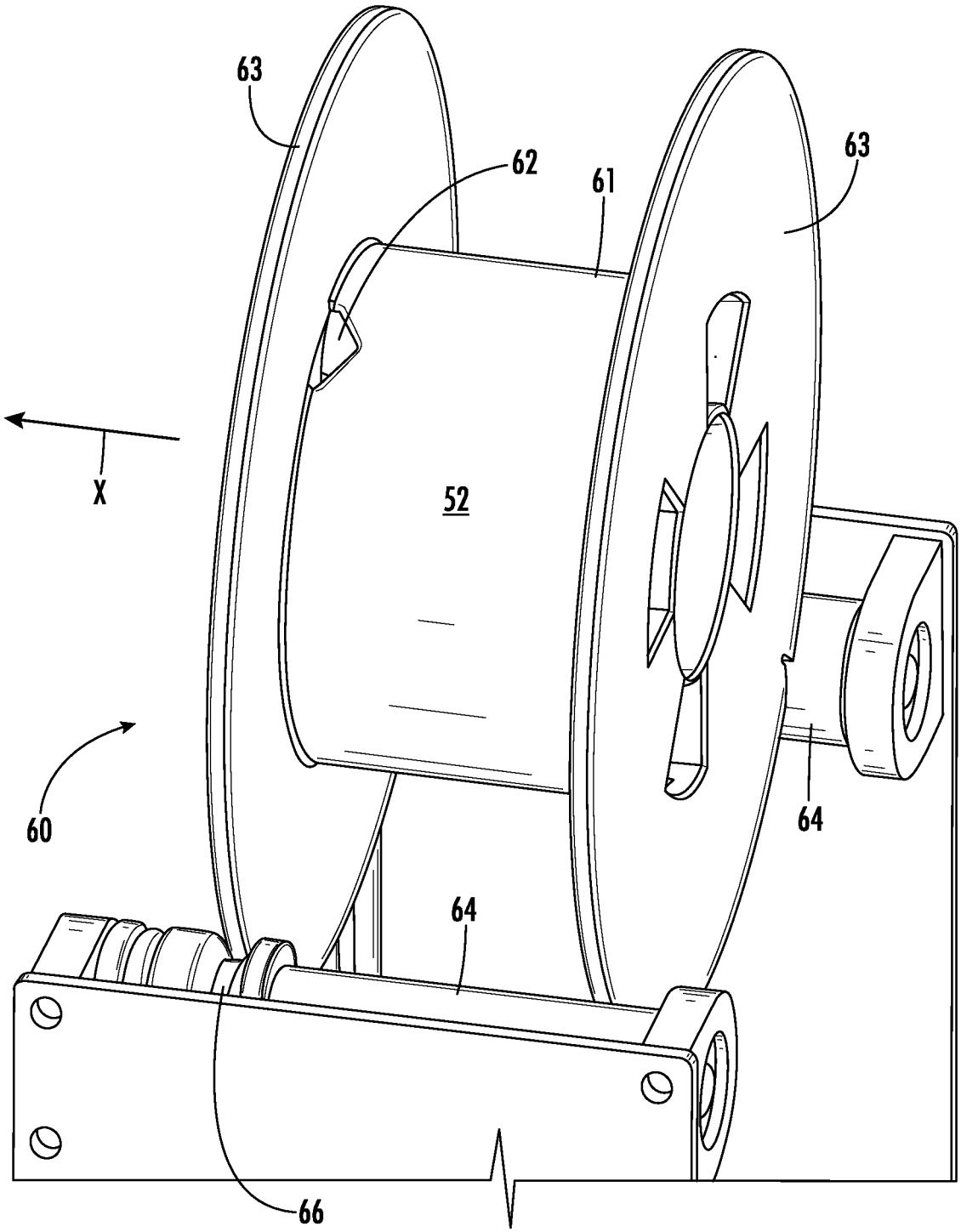
FIG. 4 is a detail perspective view of an indexing unit of the spooler of FIG. 1.

Specific operational components of the automated spooler 50 will now be described in greater detail with reference to FIGS. 4-12. FIG. 4 is a perspective view showing an empty spool 52 that has been conveyed on conveyor 54 into the interior of the enclosure 56 of the spooler 50 and positioned on an indexing unit 60 of the spooler 50. The indexing unit 60 is configured and operable to detect a feed hole 62 provided on the core or barrel 61 of the spool 52 between opposite end flanges 63 of the spool 52 for receiving an innermost free end of a continuous, elongate, flexible material to be wound onto the spool 52. The indexing unit 60 is further configured and operable for positioning the feed hole 62 at a proper location for feeding the innermost free end of the filament to the empty spool 52. In a preferred embodiment, the empty spool 52 is supported on the indexing unit 60 by rollers 64 or the like. At least one, and preferably both, of the rollers 64 are rotatable to allow the indexing unit 60 to rotate the empty spool 52 to the desired location of the feed hole 62.

The feed hole 62 defines a relatively small opening for receiving the free end of the filament relative to the elongate width of the barrel 61 of the empty spool 52. Consequently, the empty spool 52 must be accurately positioned on the rollers 64 of the indexing unit 60. Otherwise, an indexing sensor beam (not shown) of the indexing unit 60 will not be able to detect the feed hole 62 on the barrel 61 of the empty spool 52. At least one groove 66 is provided on at least one of the rollers 64 of the indexing unit 60 for receiving an end flange 63 of the empty spool 52. With an end flange 63 disposed within groove 66 of the indexing unit 60, the spool 52 will not move (i.e. slide) laterally on the rollers 64 in an axial direction X when the rollers 64 rotate to position the feed hole 62 at the location necessary for receiving the free end of the filament.

Figure 5:
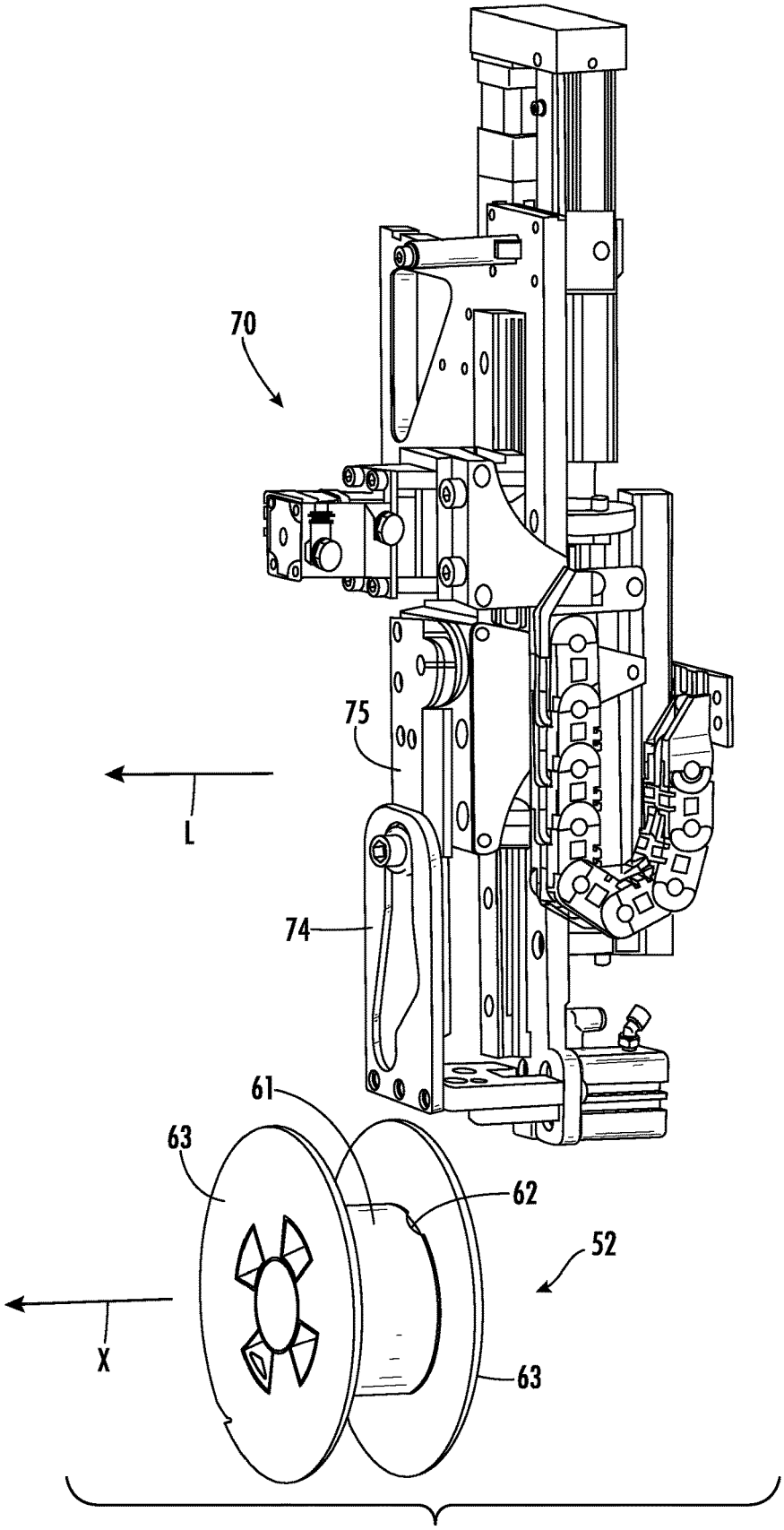
FIG. 5 is a detail perspective view of a feeding unit of the spooler of FIG. 1.
Figure 7:
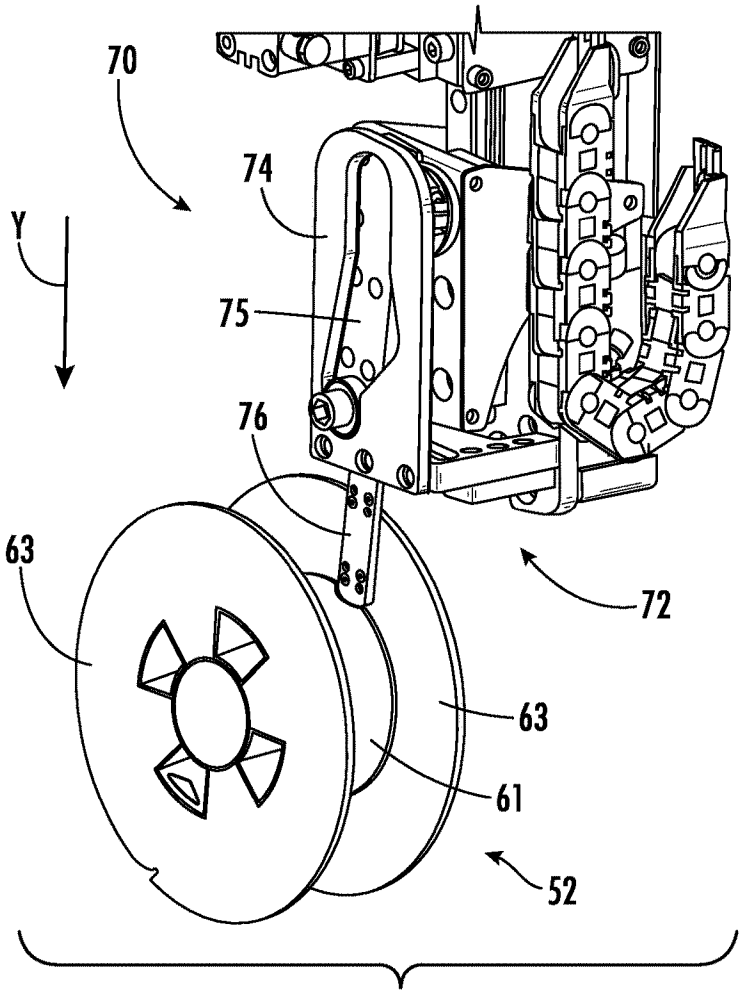
FIG. 7 is a detail perspective view showing the feeding unit of the spooler of FIG. 1 in an extended position for feeding the innermost free end of the length of the continuous, elongate, flexible material to the spool.
Figure 6:
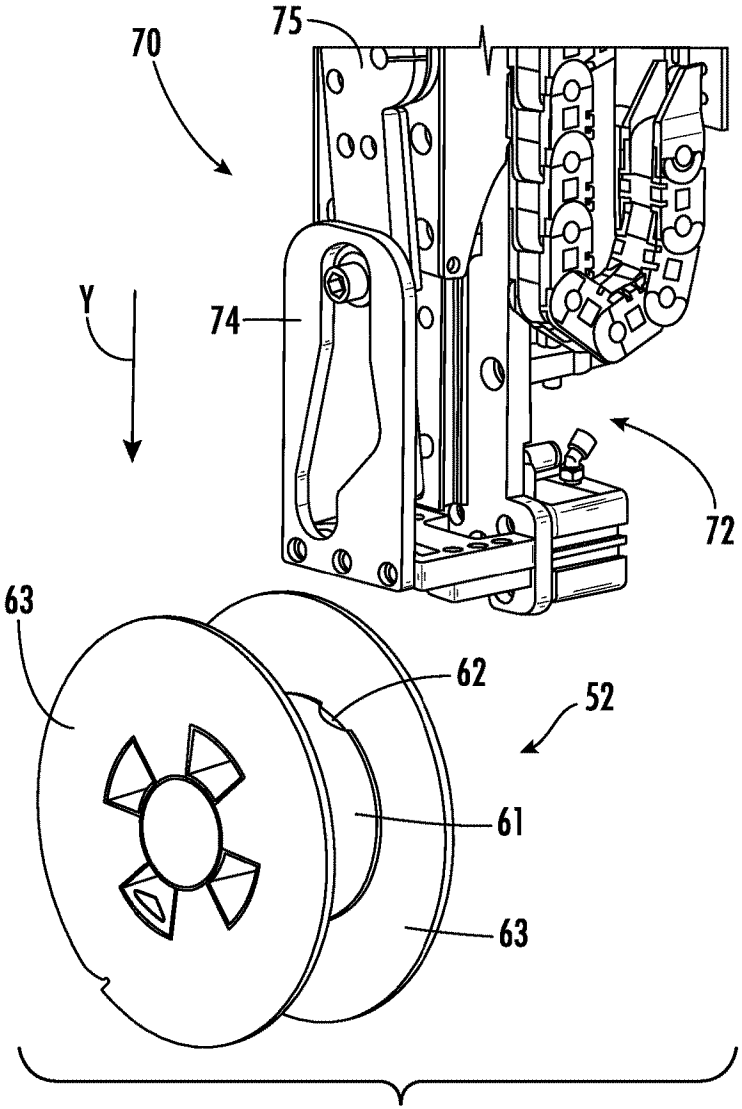
FIG. 6 is a detail perspective view showing the feeding unit of the spooler of FIG. 1 in a retracted position for feeding an innermost free end of a length of a continuous, elongate, flexible material to a spool.

FIGS. 5-7 show an exemplary embodiment of a filament feeding unit 70 of the automated spooler 50. Feeding unit 70 is configured and operable for gripping a first or innermost free end of the filament and for delivering (i.e. pulling) the innermost free end of the filament downwards to the feed hole 62 on the barrel 61 of the empty spool 52 when the feed hole 62 is positioned at the necessary location to receive the innermost free end of the filament. After the innermost free end of the filament is received within the interior of the barrel 61 of the empty spool 52 and secured, as will be described, the feeding unit 70 traverses horizontally in the lengthwise direction L during the spooling process to lay the filament on the barrel 61 between the flanges 63 of the spool 52. The feeding unit 70 may further comprise a filament cutting knife (not shown) for automatically cutting a second or outermost free end of the filament after the spooling process is complete to separate the remaining filament from the filament on the wound spool 52'.

FIGS. 5-7 illustrate an empty spool 52 that has been indexed by the indexing unit 60 (not shown for purposes of clarity; but see FIG. 4) such that the feed hole 62 is positioned at the location necessary to receive the innermost free end of the filament. As illustrated in FIGS. 5-7, the empty spool 52 has also been loaded onto a spooling head (not shown for purposes of clarity; but see FIGS. 8-9). The filament feeding unit 70 is disposed above the empty spool 52 in a ready position for feeding the free end of the filament to the empty spool 52. FIG. 6 illustrates a filament feeder 72 of the filament feeding unit 70 movable in a vertical direction Y from a retracted position shown in FIG. 6 to an extended position shown in FIG. 7. A cam plate 74 and movable cam 75 guide and position a feed tube 76 above the feed hole 62 provided on the barrel 61 of the empty spool 52. The feed tube 76 is configured and operable for feeding (delivering) the innermost free end of the filament through the feed hole 62 into the interior of the barrel 61 of the empty spool 52.

Figure 8:
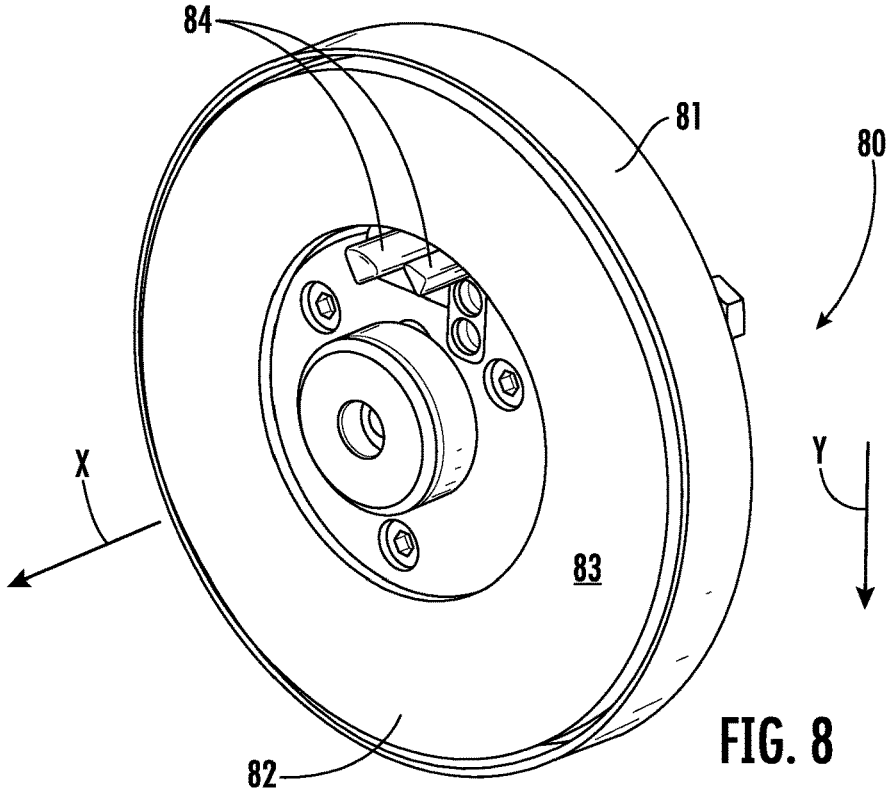
FIG. 8 is a detail perspective view showing a spooling unit of the spooler of FIG. 1 in a biased position for receiving an empty spool.
Figure 9:
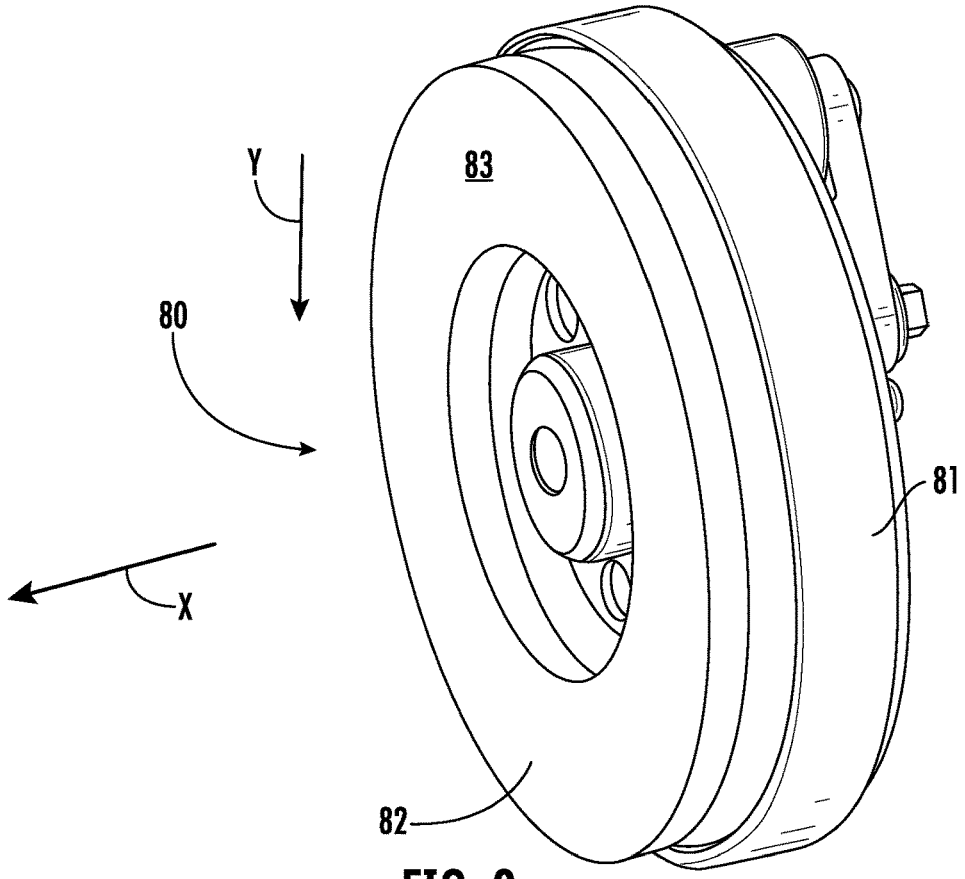
FIG. 9 is a detail perspective view showing the spooling unit of the spooler of FIG. 1 in an unbiased position for discharging a wound spool.

FIGS. 8-9 show an exemplary embodiment of a spooling unit 80 of the automated spooler 50. As shown in FIG. 8, the spooling unit 80 comprises a spool drive flange 82 of a spooling head 81 and a filament end attachment clamp 84. The spooling unit 80 is configured and operable for driving (rotating) the spool drive flange 82 of the spooling head 81, and therefore, the spool 52 during the spooling (winding) process to accumulate the filament on the barrel 61 between the end flanges 63 of the spool 52. The filament end attachment clamp 84 is configured and operable for gripping the innermost free end of the filament fed through the feed hole 62 within the barrel 61 of the spool 52 during the spooling process to retain the filament on the spool 52. As depicted herein, the filament end attachment clamp 84 comprises a pair of pins that are movably disposed within the barrel 61 of the spool 52 on either side of the feed hole 62 such that one pin is located on a first side of the feed hole 62, while the other pin is located on a second side of the feed hole 62 opposite the first side. After the innermost free end of the filament is fed (delivered) to the interior of the barrel 61 of the spool 52 through the feed hole 62, the pair of pins of the filament end attachment clamp 84 close together to thereby grip the innermost free end of the filament within the barrel 61 of the spool 52.

The spool drive flange 82 on the spooling head 81 of the spooling unit 80 is configured and operable for transferring rotational movement to the spool 52 during the spooling (winding) process. In a preferred embodiment, the spool drive flange 82 may have a covering 83 that provides increased or enhanced friction between the spool drive flange 82 and the spool 52 during the spooling process. The covering 83 may, by way of example and not limitation, be formed of an elastic material, such as rubber, hardened foam or the like. Regardless, spool drive flange 82 is movable in the axial direction X and biased by a biasing element, for example but without limitation, a compressible elastic spring. When the empty spool 52 is loaded into the spooling unit 80, a flange 63 of the spool 52 presses against the movable spool drive flange 82 and the biasing element is compressed behind the spool drive flange 82. As a result, the pair of pins of the filament end attachment clamp 84 protrude outwardly in the axial direction X from the spool drive flange 82 (see FIG. 8) to be in position to grip the innermost free end of the filament within the barrel 61 of the spool 52. Following the spooling process, the force exerted by the biasing element of the spool drive flange 82 serves to push the wound spool 52' off the retracted pins of the filament end attachment clamp 84 so that the wound spool 52' is free to move, for example, downwardly in the vertical direction Y onto the conveyor 54 to be conveyed from the enclosure 56 of the automated spooler 50 to the collection area.

Figure 11:
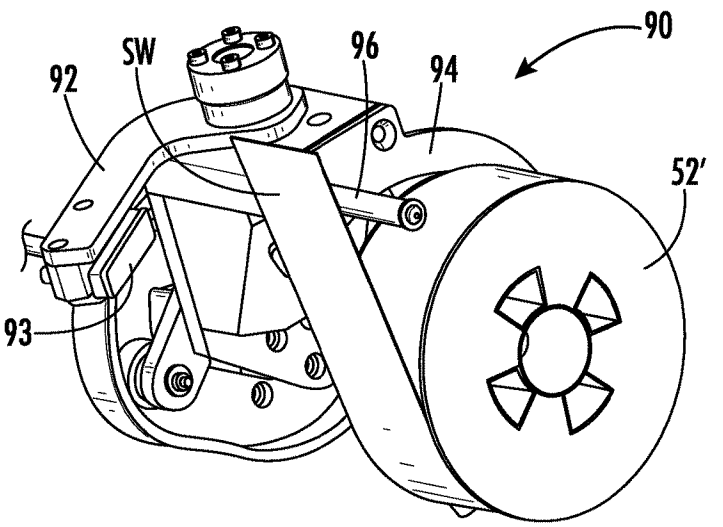
FIG. 11 is a detail perspective view showing a stretch wrap applicator of the packaging unit of FIG. 10 in an opened position.
Figure 12:
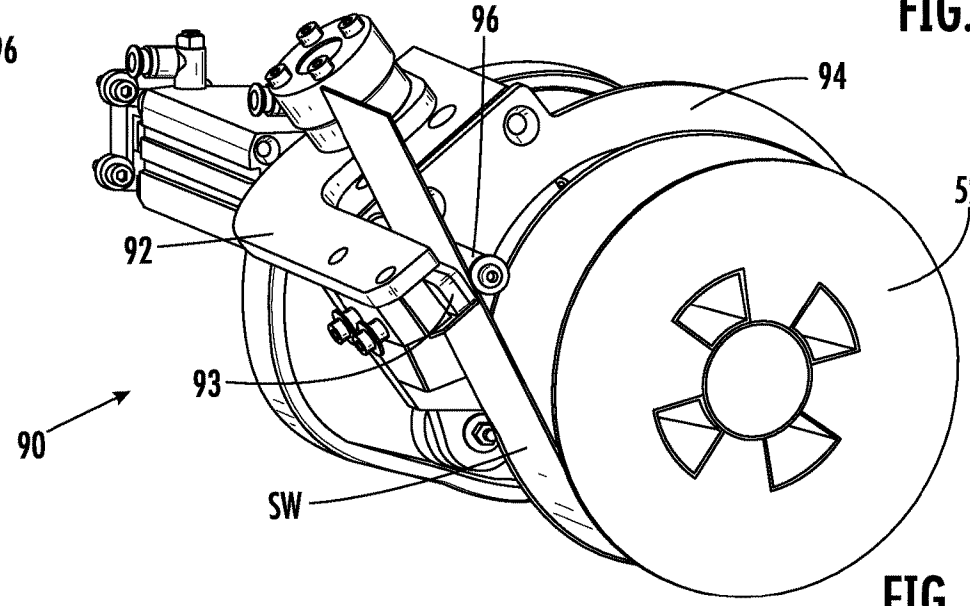
FIG. 12 is a detail perspective view showing the stretch wrap applicator of the packaging unit of FIG. 10 in a closed position.
Figure 10:
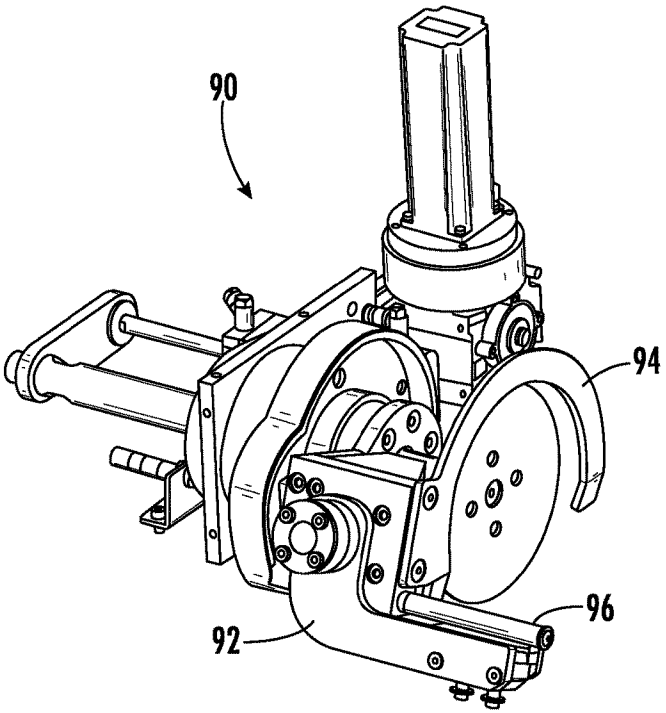
FIG. 10 is a detail perspective view showing a packaging unit for optional use with the spooler of FIG. 1.

FIGS. 10-12 show an exemplary embodiment of an optional packaging unit 90 of the automated spooler 50. The packaging unit 90, commonly referred to as a stretch wrap applicator, is configured and operable for packaging a wound spool 52' of the filament. The stretch wrap applicator 90 is essentially a clamping device comprising a movable (i.e. rotatable) clamp 92. The clamp 92 rotates around the wound spool 52' to cover the wound spool 52' with a first layer of a packaging material, such as conventional stretch wrap SW. If necessary or desired, additional layers of the stretch wrap SW are applied onto the wound spool 52' by rotating the wound spool 52' on the automated spooler 50. While the first layer of the stretch wrap SW is applied to the wound spool 52', the clamp 92 is closed for about 290 degrees of the first revolution. The clamp 92 must then be opened to release the end of the stretch wrap SW that will be wound underneath the next layer of the stretch wrap SW. Typically, movement of the clamp 92 between closed and opened is accomplished using a pneumatic cylinder. However, such movement is complicated on the automated spooler 50 of the present invention since the stretch wrap applicator 90 is necessarily mounted on a rotating part of the spooler 50. Consequently, there is a need for a pneumatic air swivel.

The stretch wrap applicator 90 of automated spooler 50 comprises a cam plate 94 having a cam profile that controls when the clamp 92 is opened or closed. FIG. 11 shows the stretch wrap applicator 90 with the clamp 92 in an opened position by the cam profile of the cam plate 94. In the configuration shown in FIG. 11, the stretch wrap applicator 90 is configured to be ready to cut and clamp the stretch wrap SW. FIG. 12 shows the stretch wrap applicator 90 with the clamp 92 rotated further from the opened position shown in FIG. 11 to a closed position. A clamp plate 93 of the clamp 92 is pressed against a stop 96 with the stretch wrap SW disposed between the clamp plate 93 and the stop 96. In a preferred embodiment, the clamp plate 93 has a covering formed from an elastic material, such as rubber or hardened foam, and the stop 96 is in the form of an elongate, cylindrical rod. Regardless, a cutting knife (not shown) underneath the clamp 92 is pressed against the stretch wrap SW disposed between the stop 96 and the clamp plate 93 to cut the stretch wrap SW.

Figure 13:
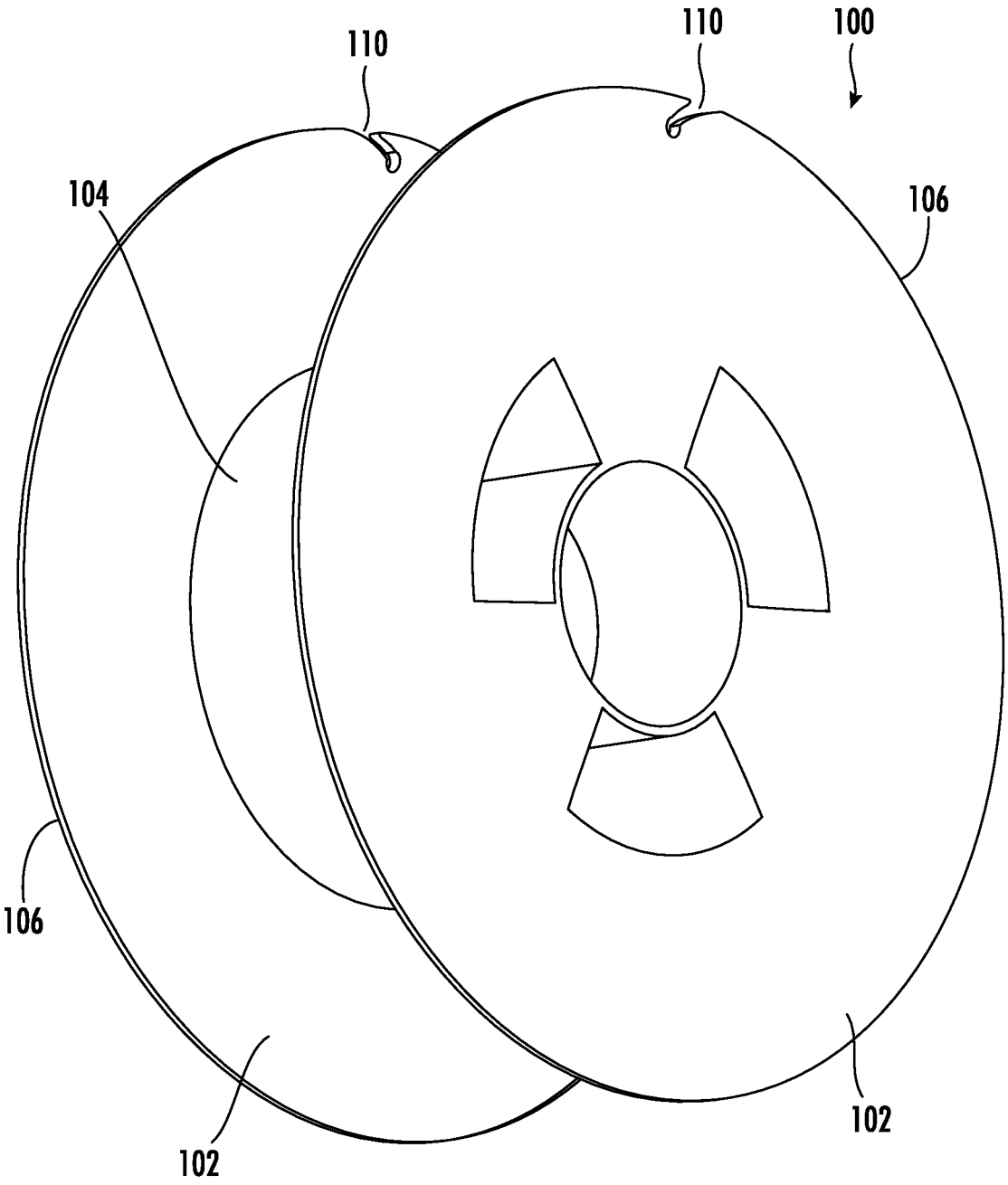
FIG. 13 is a perspective view of a spool having a flange with a locking notch according to an aspect of the present invention.

FIG. 13 shows a spool, indicated generally by reference character 100, according to an aspect of the present invention. The spool 100 has at least one flange 102 and an elongate barrel 104 defining a longitudinal axis that extends in an axial direction X. In an exemplary embodiment shown herein, the spool 100 has a pair of opposed flanges 102 disposed at opposite ends of the barrel 104. However, the spool 100 may have any number of flanges 102 disposed at any position along a length of the barrel 104 in the axial direction X. Regardless, at least one flange 102 of the spool 100 is provided with a locking notch 110 configured and operable for securing an outermost end of a material wound onto the spool 100, for example a filament F. In particular, the locking notch 110 is configured and operable for retaining an outermost free end of a length of a continuous, elongate, flexible material on an outer periphery of the flange 102 to retain the wound material on the spool during storage and transport prior to use.

As shown and described herein, spool 100 includes the barrel 104 extending in the axial direction X and a pair of flanges 102 that each extends outwardly from the barrel 104 of the spool 100 in a generally radial direction. Flanges 102 are each disposed adjacent an axial end of the barrel 104 and the locking notch 110 is formed at an outer periphery of each flange 102. In this manner, the spool 100 may be provided to a manual winding machine (commonly referred to as a winder) or to the automated spooler 50 of the present invention and wound in either orientation (i.e., left-to-right or right-to-left) to retain the outermost free end of the wound material on the spool 100. In an embodiment, each flange 102 is configured as a substantially planar, relatively thin, generally cylindrical disk and the locking notch 110 is disposed along the circumference of an outer peripheral edge or rim 106 of the flange 102. If desired, the barrel 104 of the spool 100 may further be provided with the feed hole 62 previously shown and described with respect to the automated spooler 50.

In an embodiment, the locking notch 110 defines a receiving portion 112 that extends from the outer periphery of the flange 102 and a retaining portion 114 that extends from the receiving portion 112. The receiving portion 112 may be tapered inwardly from the outer periphery of the flange 102 towards the retaining portion 114 of the locking notch 110 such that the locking notch 110 narrows in cross-sectional area from the outer periphery of the flange 102 to the receiving portion 112. Similarly, the retaining portion 114 may be tapered inwardly from the receiving portion 112 of the locking notch 110 such that the locking notch 110 narrows in cross-sectional area from the receiving portion 112 to the retaining portion 114. In an embodiment, a transition region 116 defining a relatively small cross-sectional radius may be disposed between the receiving portion 112 and the retaining portion 114 to facilitate a smooth transition of the material from the receiving portion 112 into the retaining portion 114 of the locking notch 110. In an embodiment, the receiving portion 112 or the retaining portion 114 of the locking notch 110 may have a reduced cross-section area configured and operable for securing the outermost end of the wound material on the flange 102 of the spool 100 while the material is cut.

Figure 14A:
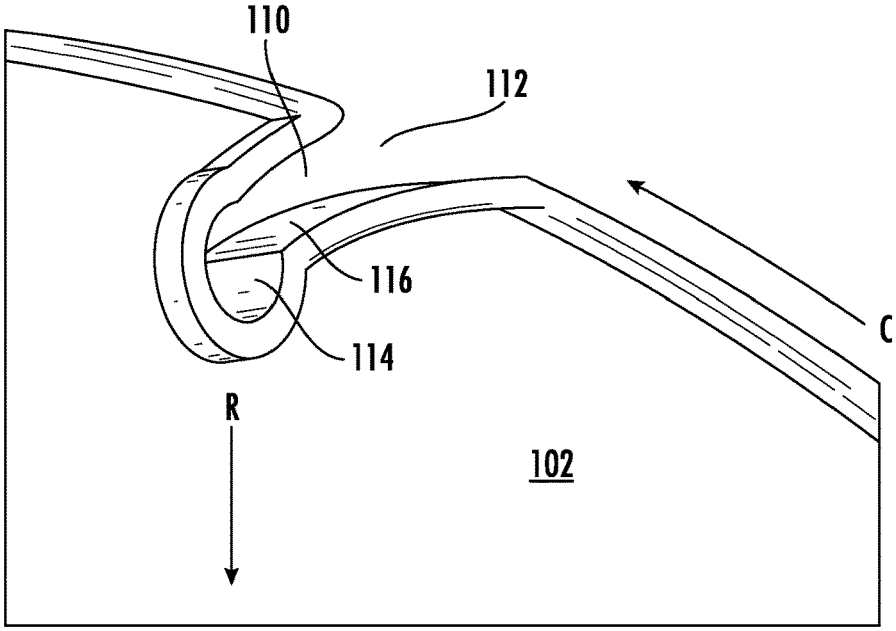
FIG. 14A is a detail perspective view of an embodiment of the locking notch of the spool of FIG. 13.
Figure 14B:
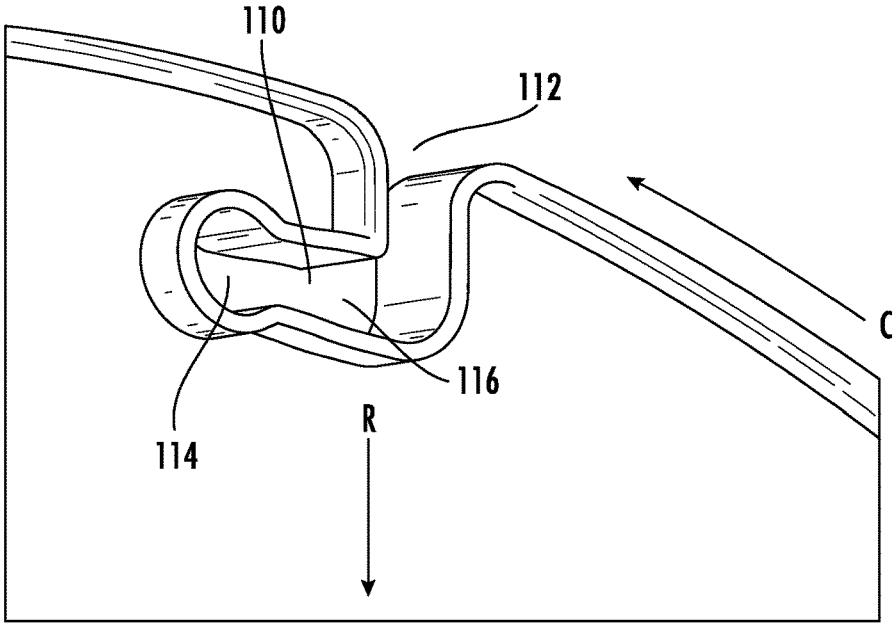
FIG. 14B is a detail perspective view of another embodiment of the locking notch of the spool of FIG. 13.

FIG. 14A shows an embodiment of a locking notch 110 of a flange 102 for a spool 100 according to the present invention. In the embodiment illustrated in FIG. 14A, the receiving portion 112 of the locking notch 110 extends in a generally circumferential direction, indicated generally by reference character C, while the retaining portion 114 of the locking notch 110 extends in a generally radial direction, indicated generally by reference character R. FIG. 14B shows another embodiment of a locking notch 110 of a flange 102 for a spool 100 according to the present invention. In the embodiment illustrated in FIG. 14B, the receiving portion 112 of the locking notch 110 extends in the generally radial direction R, while the retaining portion 114 of the locking notch 110 extends in the generally circumferential direction C. In both embodiments illustrated in FIG. 14A and FIG. 14B, an outermost end of a length of continuous, elongate, flexible material wound on the spool 100 is received within the receiving portion 112 of the locking notch 110 and retained within the retaining portion 114 of the locking notch 110. The transition region 116 of the locking notch 110 guides the material into the retaining portion 114 of the locking notch 110 and serves to prevent the material from being inadvertently removed from the retaining portion 114 of the locking notch 110.

By way of example and not limitation, FIGS. 15A-17A illustrate the feeding unit 70 of the spooler 50 configured and operable for retaining an outermost end of a length of a continuous, elongate, flexible material, such as filament F, within a locking notch 110 provided on a spool 100 of the embodiment shown in FIG. 14A. Similarly, FIGS. 15B-17B illustrate the feeding unit 70 of the spooler 50 configured and operable for retaining an outermost end of a length of a continuous, elongate, flexible material, such as filament F, within a locking notch 110 provided on a spool 100 of the embodiment shown in FIG. 14B. For purposes of illustration only, the spool 100 begins the spooling process as one of the empty spools 52 of the spooler 50 and completes the spooling process as one of the wound spools 52' of the spooler 50.

Figure 15B:
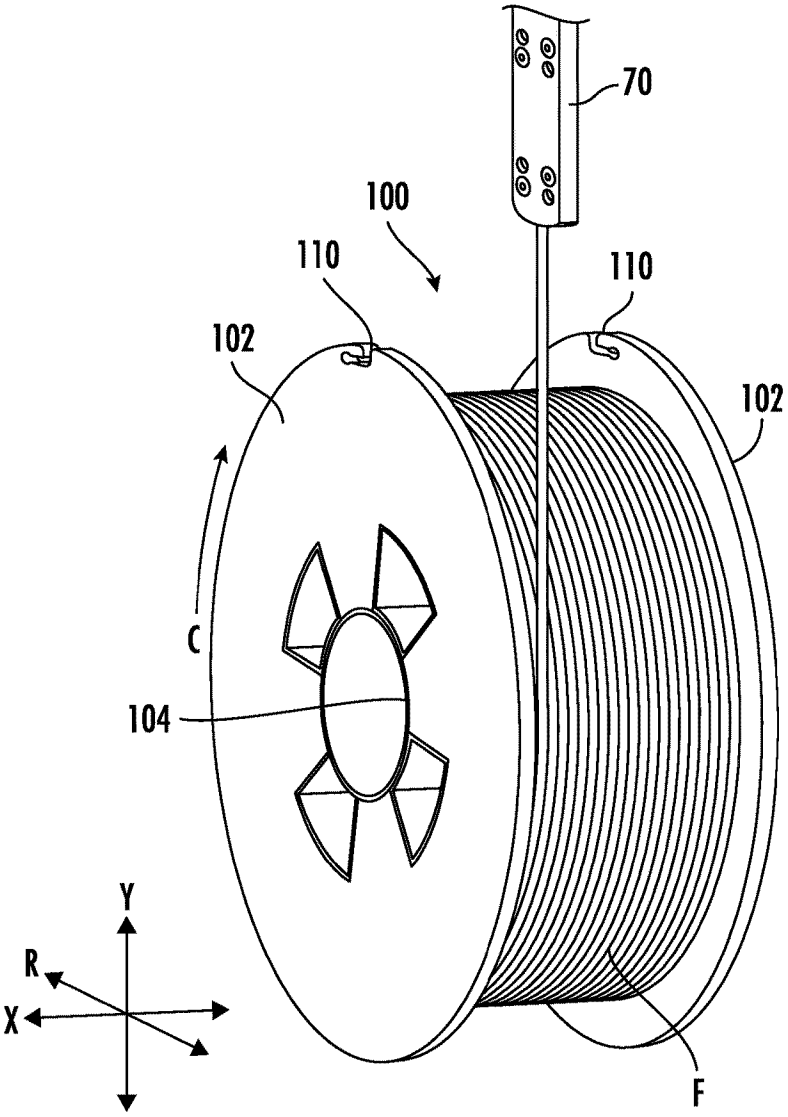
FIG. 15B is a perspective view illustrating an initial position of the feeding unit of the spooler of FIG. 1 and the spool of FIG. 13 for receiving and retaining the wound material on the spool within the locking notch of 14B.
Figure 15A:
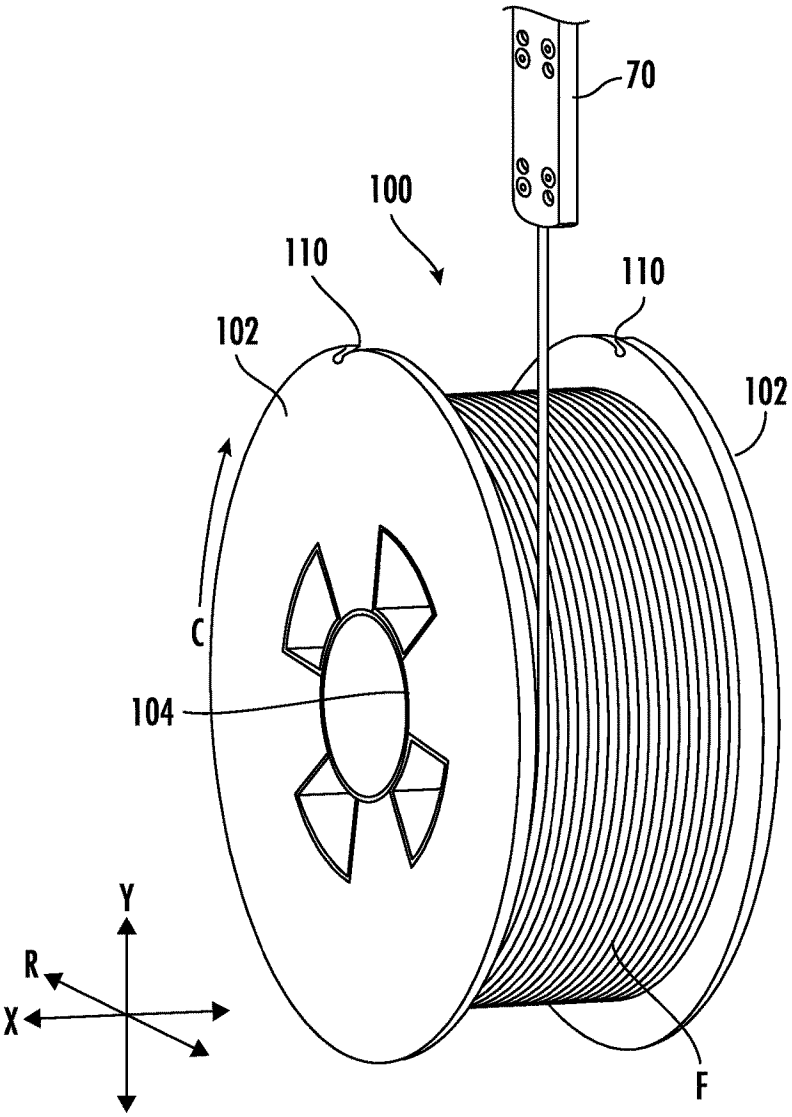
FIG. 15A is a perspective view illustrating an initial position of the feeding unit of the spooler of FIG. 1 and the spool of FIG. 13 for receiving and retaining the wound material on the spool within the locking notch of FIG. 14A.

FIG. 15A illustrates an initial position of the feeding unit 70 of the spooler 50 and the spool 100 after completion of the spooling process. As such, the feeding unit 70 previously traversed laterally back and forth along the length of the elongate barrel 104 of the spool 100 in the axial direction X a number of times as the spool 100 rotated about the longitudinal axis of the barrel 104 in the circumferential direction C to lay multiple layers of the filament F onto the spool 100. As shown in FIG. 15A, the feeding unit 70 is positioned adjacent a flange 102 of the spool 100 having a locking notch 110. In an embodiment, the feeding unit 70 is positioned slightly forward (i.e., in front) of the spool 100 in a radial direction, indicated generally by reference character R, and above the spool 100 in a vertical direction, indicated generally by reference character Y. The locking notch 110 provided on the flange 102 is positioned behind (i.e., to the rear of) the outermost end of the filament F in the circumferential direction C of rotation of the spool 100.

Figure 16B:
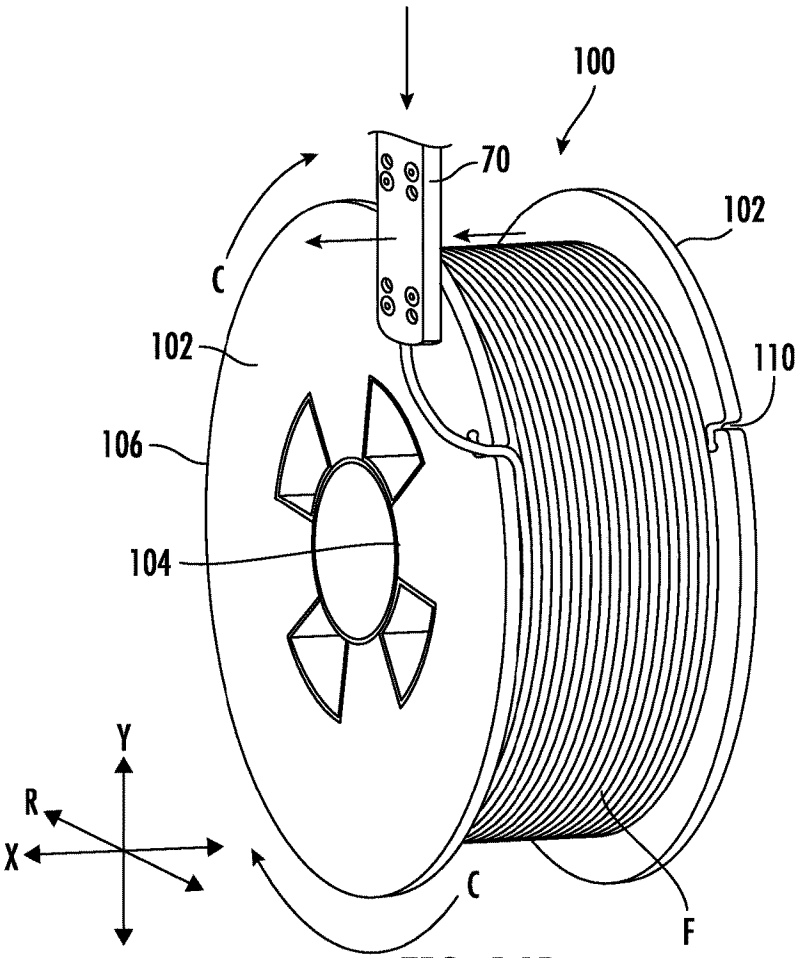
FIG. 16B is a perspective view illustrating an intermediate position of the feeding unit of the spooler of FIG. 1 and the spool of FIG. 13 for receiving and retaining the wound material on the spool within the locking notch of FIG. 14B.
Figure 16A:
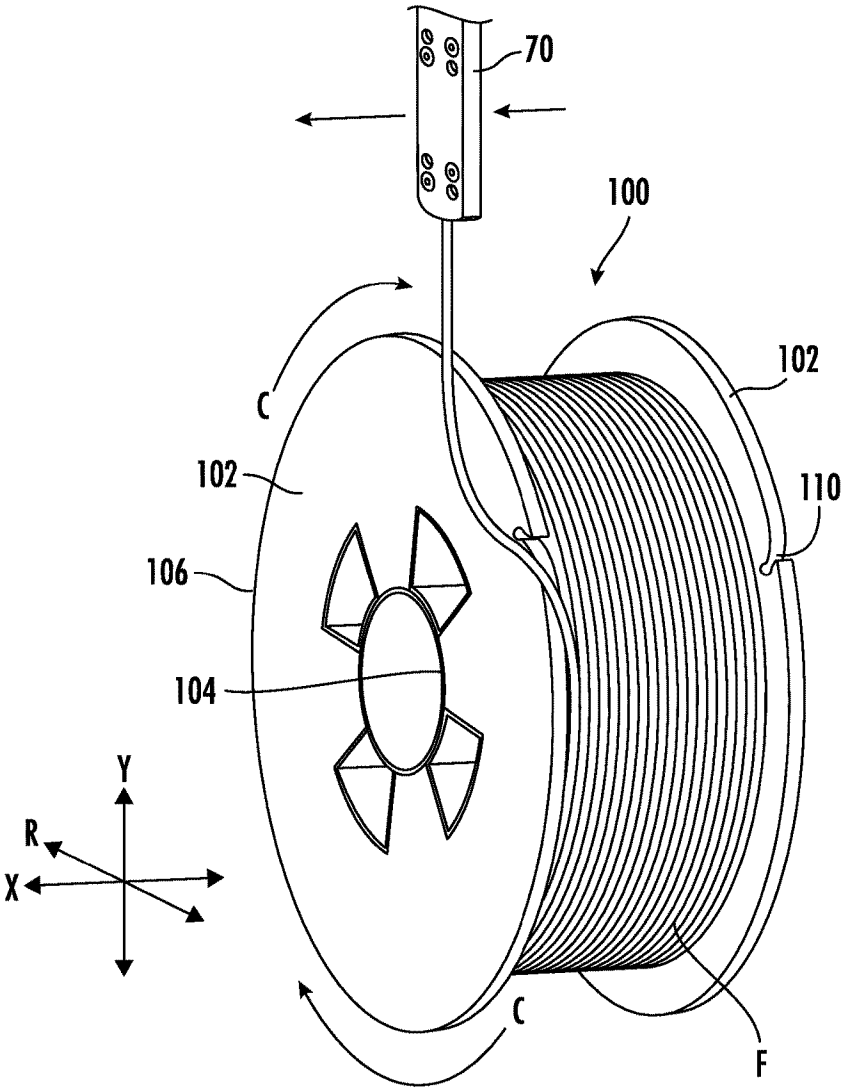
FIG. 16A is a perspective view illustrating an intermediate position of the feeding unit of the spooler of FIG. 1 and the spool of FIG. 13 for receiving and retaining the wound material on the spool within the locking notch of FIG. 14A.
Figure 17B:
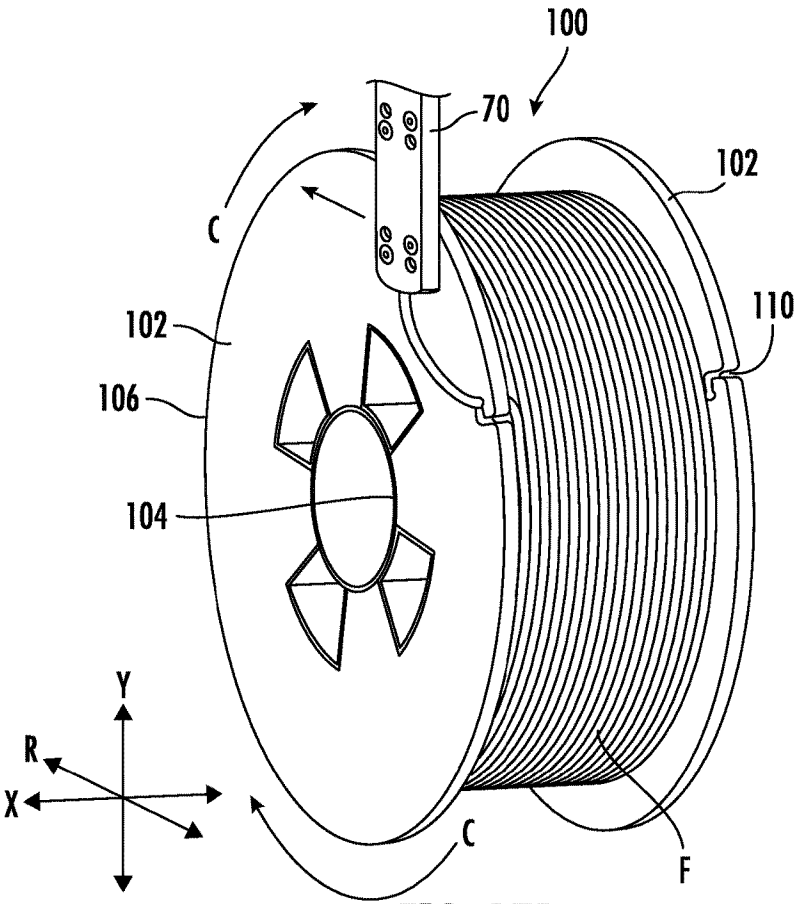
FIG. 17B is a perspective view illustrating a final position of the feeding unit of the spooler of FIG. 1 and the spool of FIG. 13 for receiving and retaining the wound material on the spool within the locking notch of FIG. 14B.
Figure 17A:
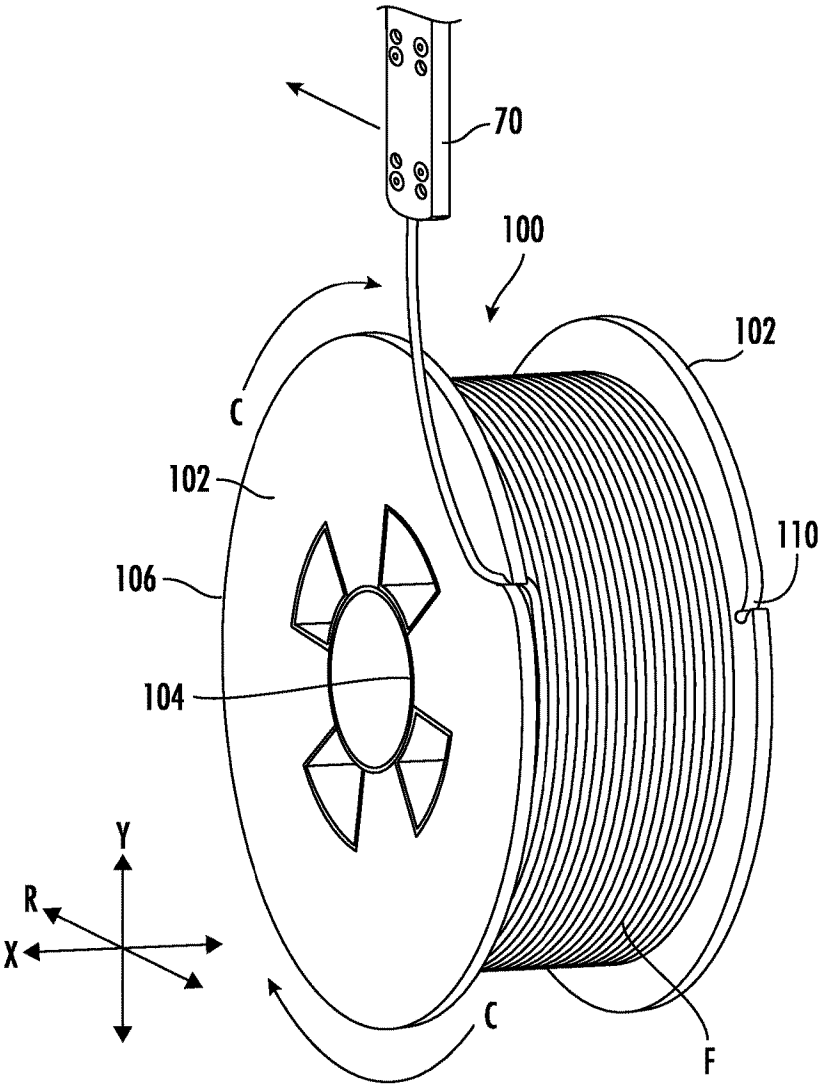
FIG. 17A is a perspective view illustrating a final position of the feeding unit of the spooler of FIG. 1 and the spool of FIG. 13 for receiving and retaining the wound material on the spool within the locking notch of FIG. 14A.

FIG. 16A illustrates an intermediate position of the feeding unit 70 of the spooler 50 and the spool 100 after completion of the spooling process. The feeding unit 70 moves laterally in the axial direction X beyond the peripheral edge or rim 106 of the flange 102 as the spool 100 rotates in the circumferential direction C. As a result, the outermost end of the filament F is received within the receiving portion 112 of the locking notch 110 provided on the flange 102 of the spool 100. FIG. 17A illustrates a final position of the feeding unit 70 of the spooler 50 and the spool 100 after completion of the spooling process. The feeding unit 70 moves generally rearwardly and/or inwardly in the radial direction R relative to the peripheral edge or rim 106 of the flange 102 of the spool 100. As a result, the outermost end of the filament F moves from the receiving portion 112 of the locking notch 110 to the retaining portion 114 of the locking notch 110 through the transition region 116. If desired, the spool 100 may be rotated slightly further in the circumferential direction C to secure the outermost end of the filament F within the retaining portion 114 of the locking notch 110 so that the outermost end of the filament F may be separated (i.e., cut) from the remaining material.

FIG. 15B illustrates an initial position of the feeding unit 70 of the spooler 50 and the spool 100 after completion of the spooling process. As such, the feeding unit 70 previously traversed laterally back and forth along the length of the elongate barrel 104 of the spool 100 in the axial direction X a number of times as the spool 100 rotated about the longitudinal axis of the barrel 104 in the circumferential direction C to lay multiple layers of the filament F onto the spool 100. As shown in FIG. 15B, the feeding unit 70 is positioned adjacent a flange 102 of the spool 100 having a locking notch 110. In an embodiment, the feeding unit 70 is positioned slightly forward (i.e., in front) of the spool 100 in a radial direction, indicated generally by reference character R, and above the spool 100 in a vertical direction, indicated generally by reference character Y. The locking notch 110 provided on the flange 102 is positioned behind (i.e., to the rear of) the outermost end of the filament F in the circumferential direction C of rotation of the spool 100. Consequently, the position of the feeding unit 70 and the spool 100 is essentially the same as shown in FIG. 15A.

FIG. 16B illustrates an intermediate position of the feeding unit 70 of the spooler 50 and the spool 100 after completion of the spooling process. The spool 100 rotates in the circumferential direction C and the feeding unit 70 first moves laterally in the axial direction X beyond the peripheral edge or rim 106 of the flange 102 and then moves downward in the vertical direction Y. As a result, the outermost end of the filament F is received within the receiving portion 112 of the locking notch 110 provided on the flange 102 of the spool 100. FIG. 17B illustrates a final position of the feeding unit 70 of the spooler 50 and the spool 100 after completion of the spooling process. The feeding unit 70 moves generally rearwardly and/or inwardly in the radial direction R relative to the peripheral edge or rim 106 of the flange 102 of the spool 100 as the spool 100 is further rotated slightly in the circumferential direction C. As a result, the outermost end of the filament F moves from the receiving portion 112 of the locking notch 110 to the retaining portion 114 of the locking notch 110 through the transition region 116 to secure the outermost end of the filament F within the retaining portion 114 of the locking notch 110 so that the outermost end of the filament F may be separated (i.e., cut) from the remaining material.

The foregoing description in conjunction with the accompanying drawing figures has disclosed one or more exemplary embodiments of an automated spooler for winding and optionally packaging a predetermined length of a continuous, elongate, flexible material, such as a three-dimensional (3D) printing filament for use in a three-dimensional (3D) printing production. In exemplary embodiments, the automated spooler includes an indexing unit configured and operable for positioning a feed hole of an empty spool at a location for receiving an innermost free end of the material within a barrel of the spool. The automated spooler further includes a feeding unit configured and operable for feeding the material to the spool. The automated spooler further includes a spooling unit with a spooling head having a biased spool drive flange and a movable attachment clamp configured and operable for gripping the innermost free end of the material through the feed hole of the spool. The automated spooler further includes an optional packaging unit (e.g., stretch wrap applicator) configured and operable for applying a packaging material, such as at least one layer of a stretch wrap, over the material on the wound spool.

The foregoing description in conjunction with the accompanying drawing figures has also disclosed one or more exemplary embodiments of a spool having at least one flange with a locking notch for securing an outermost free end of a length of a continuous, elongate, flexible material, such as a three-dimensional (3D) printing filament for use in a three-dimensional (3D) printing production. The locking notch includes a receiving portion for receiving the outermost end of the material and a retaining portion for retaining the outermost end of the material within the locking notch. The locking notch may further include a transition region disposed between the receiving portion and the retaining portion. The receiving portion of the locking notch or the retaining portion of the locking notch may have a reduced cross-section area for securing the outermost free end of the material within the locking notch. In any event, the spool having a flange with a locking notch obviates the need for providing an optional stretch wrap applicator on a spooler to reduce the complexity and cost, while increasing the efficiency of the spooler.

While exemplary embodiments of the invention have been described and shown in the accompanying drawing figures, those of ordinary skill in the art will readily acknowledge and appreciate that the apparatus, systems and methods of the present invention(s) may be embodied in numerous other forms and manners without departing from the broad intended scope of this disclosure. Accordingly, it is to be understood that this disclosure and any appended claims are to be interpreted given their broadest reasonable interpretation consistent with the forgoing written description and the accompanying drawings.

That which is claimed is:

1. A spool configured for winding a length of a continuous, elongate, flexible material onto the spool, comprising:
- an elongate barrel defining a longitudinal axis in an axial direction and having a length in the axial direction; and
- at least one flange disposed along the length of the barrel;
- wherein the at least one flange is provided with a locking notch on an outer periphery of the flange;
- wherein the locking notch comprises a receiving portion for receiving the material within the locking notch and a retaining portion for retaining the material within the locking notch of the at least one flange of the spool;
- wherein an innermost end of the material is received within a feeding hole of the barrel of the spool, and wherein an outermost end of the material is received within the locking notch of the at least one flange of the spool; and
- wherein an attachment clamp of a spooler comprises a pair of pins disposed within the barrel of the spool that close together to thereby grip the innermost end of the material within an interior of the barrel of the spool.

2. The spool according to claim 1, wherein the locking notch further comprises a transition region between the receiving portion of the locking notch and the retaining portion of the locking notch.

3. The spool according to claim 1, wherein at least one of the receiving portion of the locking notch and the retaining portion of the locking notch has a reduced cross-section area for securing the material within the locking notch of the at least one flange of the spool.

4. The spool according to claim 1, wherein the receiving portion of the locking notch extends in a generally circumferential direction of the at least one flange of the spool.

5. The spool according to claim 4, wherein the retaining portion of the locking notch extends in a generally radial direction of the at least one flange of the spool.

6. The spool according to claim 1, wherein the receiving portion of the locking notch extends in a generally radial direction of the at least one flange of the spool.

7. The spool according to claim 6, wherein the retaining portion of the locking notch extends in a generally circumferential direction of the at least one flange of the spool.

8. The spool according to claim 1, wherein a spool drive flange of a spooler is operable for transferring rotational movement to the spool during a spooling process.

9. A spool configured for winding a length of a continuous, elongate, flexible material onto the spool, comprising:
- an elongate barrel defining a longitudinal axis in an axial direction and having a length in the axial direction; and
- at least one flange disposed along the length of the barrel;
- wherein the at least one flange is provided with a locking notch on an outer periphery of the flange;
- wherein the locking notch comprises a receiving portion for receiving the material within the locking notch and a retaining portion for retaining the material within the locking notch of the at least one flange of the spool;
- wherein an innermost end of the material is received within a feeding hole of the barrel of the spool, and wherein an outermost end of the material is received within the locking notch of the at least one flange of the spool;
- wherein a spool drive flange of a spooler is operable for transferring rotational movement to the spool during a spooling process; and wherein the spool drive flange has a covering that provides increased friction between the spool drive flange and the spool during the spooling process.

10. A spool configured for winding a length of a continuous, elongate, flexible material onto the spool, comprising:

an elongate barrel defining a longitudinal axis in an axial direction and having a length in the axial direction; and at least one flange disposed along the length of the barrel;

wherein the at least one flange is provided with a locking notch on an outer periphery of the flange;

wherein the locking notch comprises a receiving portion for receiving the material within the locking notch and a retaining portion for retaining the material within the locking notch of the at least one flange of the spool;

wherein an innermost end of the material is received within a feeding hole of the barrel of the spool, and wherein an outermost end of the material is received within the locking notch of the at least one flange of the spool;

wherein a spool drive flange of a spooler is operable for transferring rotational movement to the spool during a spooling process; and wherein a feeding unit of the spooler is operable for feeding the innermost end of the material to the spool and the spool drive flange is operable for winding the material onto the spool during the spooling process.

11. The spool according to claim 10, wherein after completion of the spooling process the feeding unit moves the outermost end of the material in the axial direction beyond the at least one flange of the spool.

12. The spool according to claim 11, wherein the spool drive flange rotates the spool in a generally circumferential direction so that the outermost end of the material is received within the locking notch of the at least one flange of the spool.

13. The spool according to claim 11, wherein the feeding unit then moves the outermost end of the material in a generally radial direction so that the outermost end of the material is received within the locking notch of the at least one flange of the spool.

14. The spool according to claim 13, wherein the spool drive flange then rotates the spool in a generally circumferential direction so that the outermost end of the material is received within the retaining portion of the locking notch of the at least one flange of the spool.

15. A method for retaining a length of a continuous, elongate, flexible material on a spool, comprising:

providing a spool having at least one flange provided with a locking notch;

winding the material onto the spool;

receiving an outermost end of the material within the locking notch provided on the at least one flange of the spool;

wherein the locking notch comprises a receiving portion for receiving the outermost end of the material and a retaining portion for retaining the outermost end of the material within the locking notch of the at least one flange of the spool; and providing a feeding unit for feeding the material to the spool, wherein the feeding unit is movable in an axial direction to position the outermost end of the material beyond an outer periphery of the at least one flange of the spool in the axial direction.

16. The method according to claim 15, further comprising moving the feeding unit in at least one of a vertical direction and a radial direction so that the outermost end of the material is received within the locking notch of the at least one flange of the spool.

* * * * *